US011731035B1

(12) United States Patent
Denbigh et al.

(10) Patent No.: US 11,731,035 B1
(45) **Date of Patent: *Aug. 22, 2023**

(54) SYSTEMS, DEVICES, AND/OR METHODS FOR PROVIDING MULTI-REALM GAME PLAY

(71) Applicant: Denbigh and Associates, LLC, Staunton, VA (US)

(72) Inventors: Peter Denbigh, Staunton, VA (US); Caitlin Cooper, Staunton, VA (US); David Khoshpasand, Lexington, VA (US); Amy Lessley, Staunton, VA (US)

(73) Assignee: Denbigh and Associates, LLC, Staunton, VA (US)

( * ) Notice: Subject to any disclaimer, the term of this patent is extended or adjusted under 35 U.S.C. 154(b) by 108 days.

This patent is subject to a terminal disclaimer.

(21) Appl. No.: 17/473,082

(22) Filed: Sep. 13, 2021

Related U.S. Application Data

(63) Continuation of application No. 17/180,981, filed on Feb. 22, 2021, now Pat. No. 11,117,046.

(60) Provisional application No. 62/979,637, filed on Feb. 21, 2020.

(51) Int. Cl.
*A63F 3/00* (2006.01)

(52) U.S. Cl.
CPC ..... *A63F 3/00261* (2013.01)

(58) Field of Classification Search
CPC ..... A63F 3/00261; A63F 3/0052; A63F 2003/00287; A63F 2003/00372; A63F 2003/0063
See application file for complete search history.

(56) References Cited

U.S. PATENT DOCUMENTS

| | | | | |
|---|---|---|---|---|
| 6,155,571 | A * | 12/2000 | Reinertsen | A63B 63/06 273/127 D |
| 8,505,918 | B1 * | 8/2013 | Appelblatt | A63F 3/00094 273/271 |
| 11,117,046 | B1 * | 9/2021 | Denbigh | A63F 3/0052 |
| 2014/0077456 | A1 * | 3/2014 | Bazarko | A63F 9/30 273/280 |
| 2021/0187383 | A1 * | 6/2021 | Hite | A63F 3/00261 |

* cited by examiner

*Primary Examiner* — Michael D Dennis
(74) *Attorney, Agent, or Firm* — Michael Haynes PLC; Michael N. Haynes

(57) ABSTRACT

Certain exemplary embodiments can provide a system, machine, device, manufacture, circuit, and/or user interface adapted for and/or resulting from, and/or a method for activities that can comprise and/or relate to, a board game system that can include a first game board that defines a plurality of playing surfaces for use with game pieces.

18 Claims, 14 Drawing Sheets

SYSTEMS, DEVICES, AND/OR METHODS FOR PROVIDING MULTI-REALM GAME PLAY

CROSS-REFERENCES TO RELATED APPLICATIONS

This application claims priority to, and incorporates by reference herein in its entirety, U.S. Provisional Patent Application 62/979,637, filed 21 Feb. 2020.

BRIEF DESCRIPTION OF THE DRAWINGS

A wide variety of potential, feasible, and/or useful embodiments will be more readily understood through the herein-provided, non-limiting, non-exhaustive description of certain exemplary embodiments, with reference to the accompanying exemplary drawings in which.

Drawing Key

Figure 1:
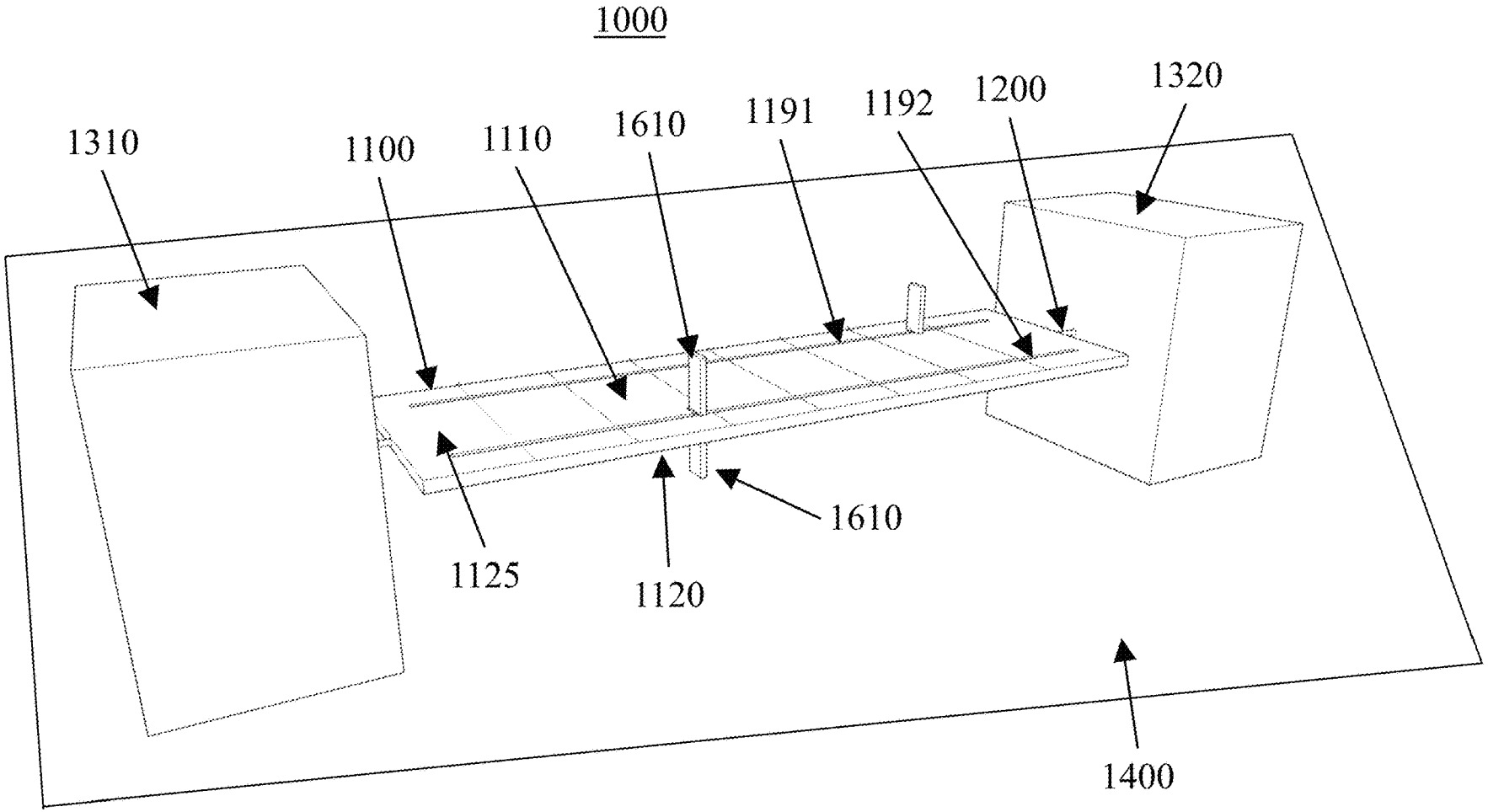
FIG. 1 is a perspective view of an exemplary embodiment of a system.
Figure 2:
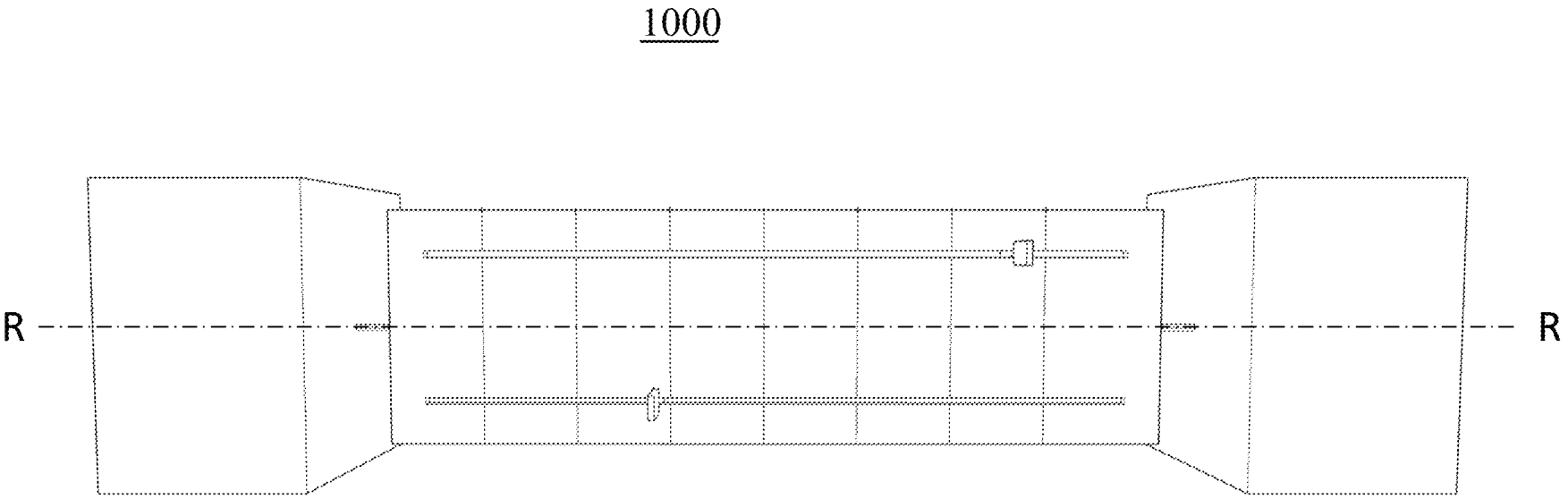
FIG. 2 is a top view of an exemplary embodiment of a system.
Figure 3:
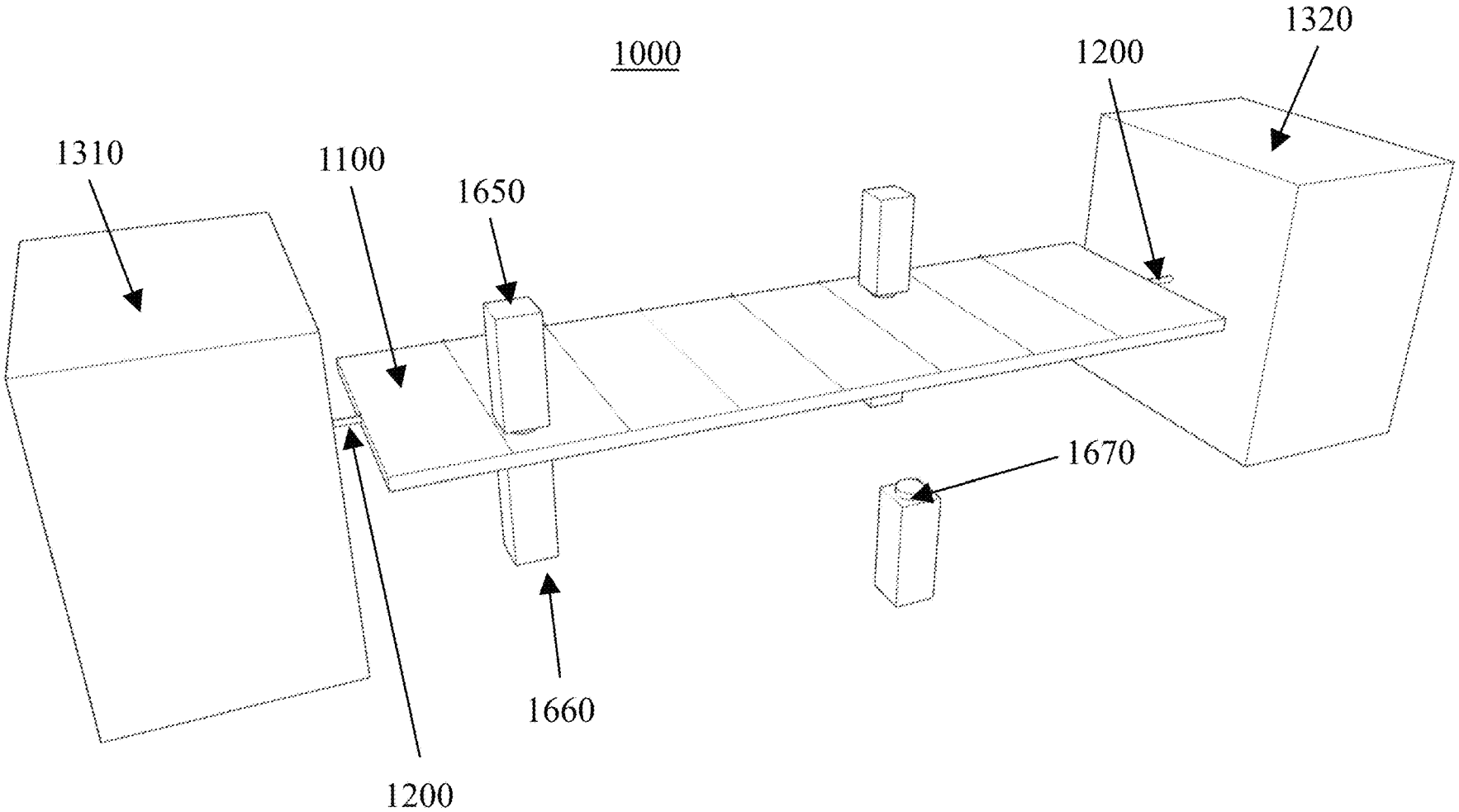
FIG. 3 is a perspective view of an exemplary embodiment of a system.
Figure 4B:
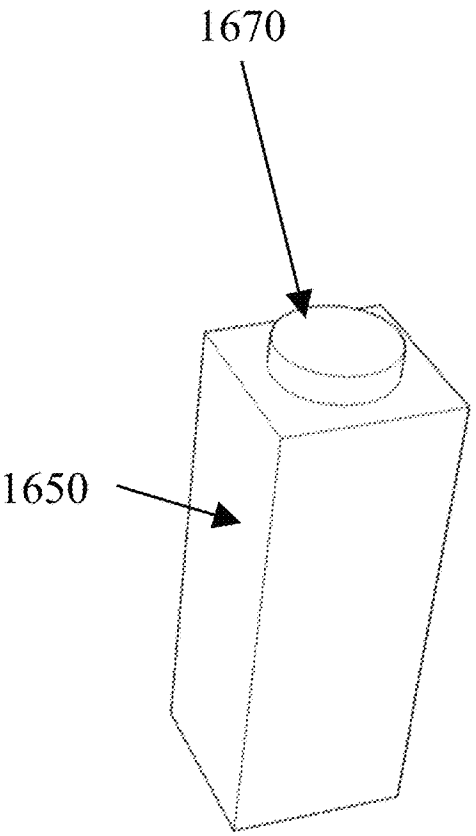
FIG. 4*b* is a perspective view of an exemplary embodiment of a game piece.
Figure 4A:
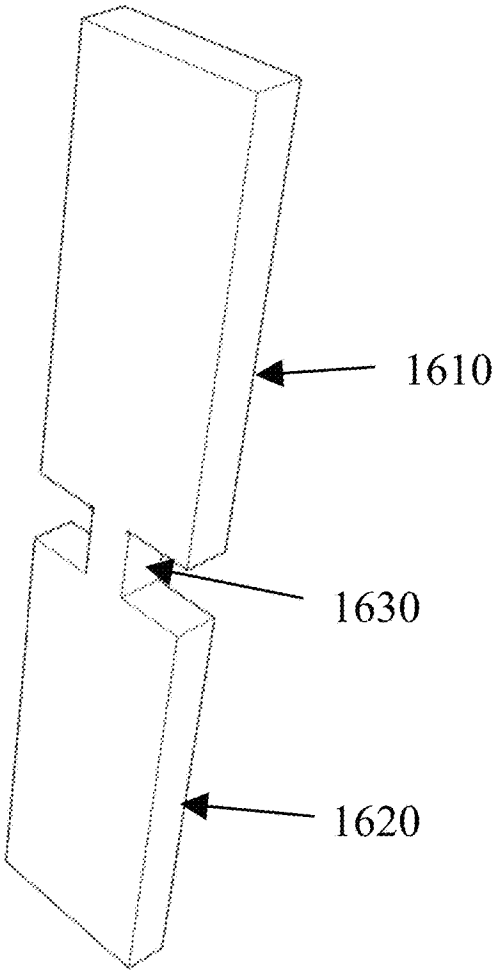
FIG. 4*a* is a perspective view of an exemplary embodiment of a game piece.
Figure 5:
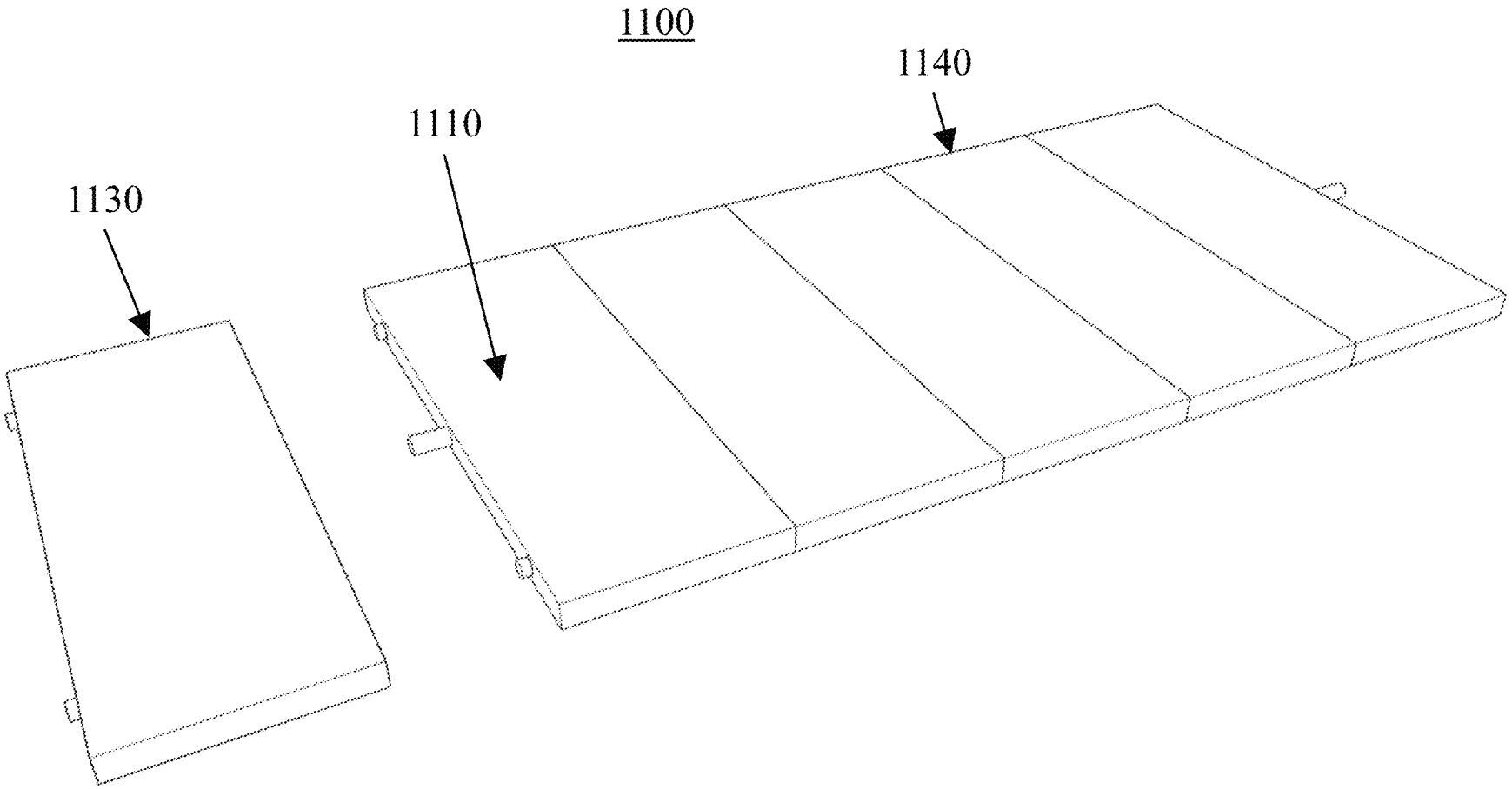
FIG. 5 is a perspective view of an exemplary embodiment of a game board.
Figure 6:
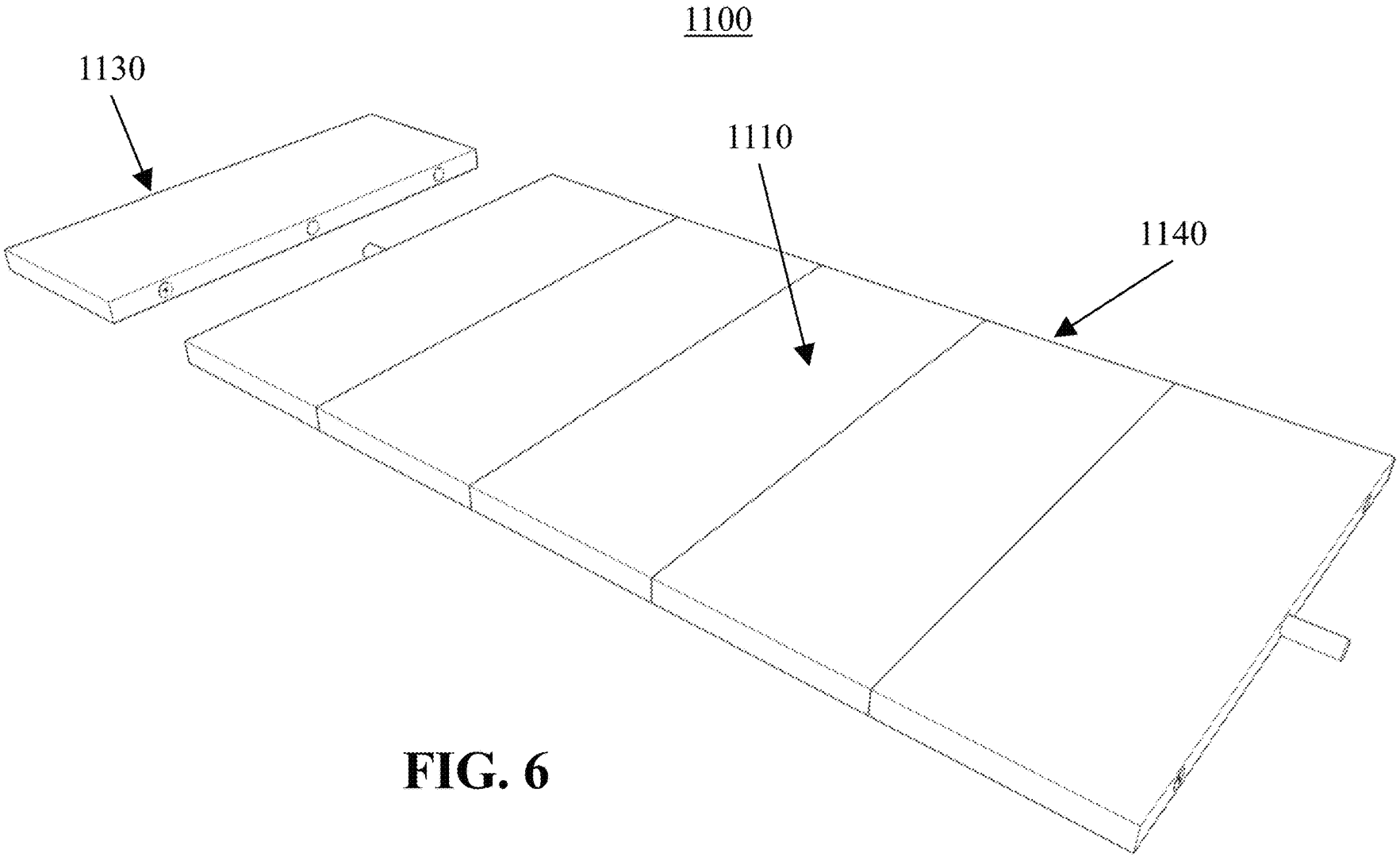
FIG. 6 is a perspective view of an exemplary embodiment of a game board.
Figure 7:
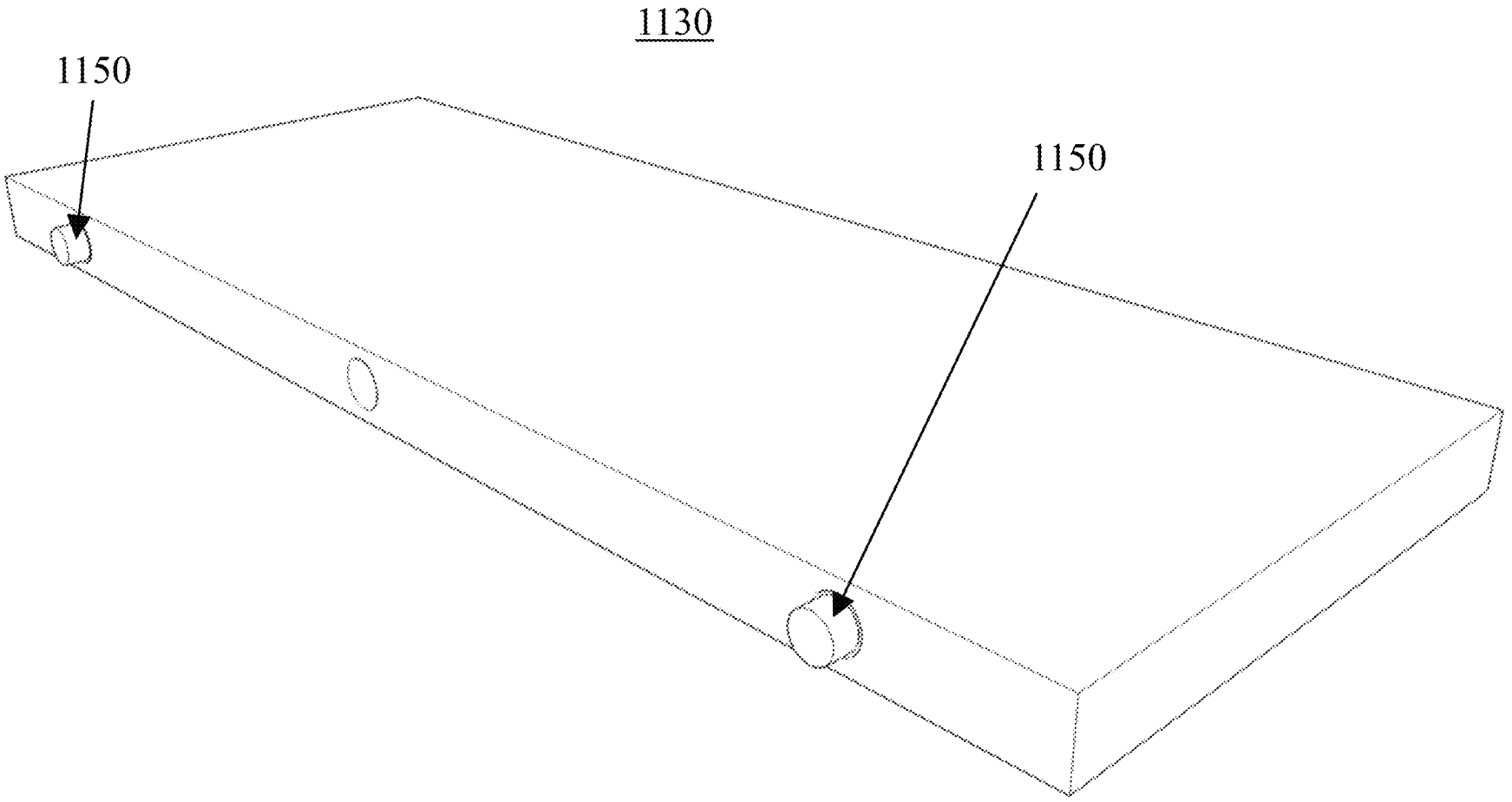
FIG. 7 is a perspective view of an exemplary embodiment of a game board segment.
Figure 8:
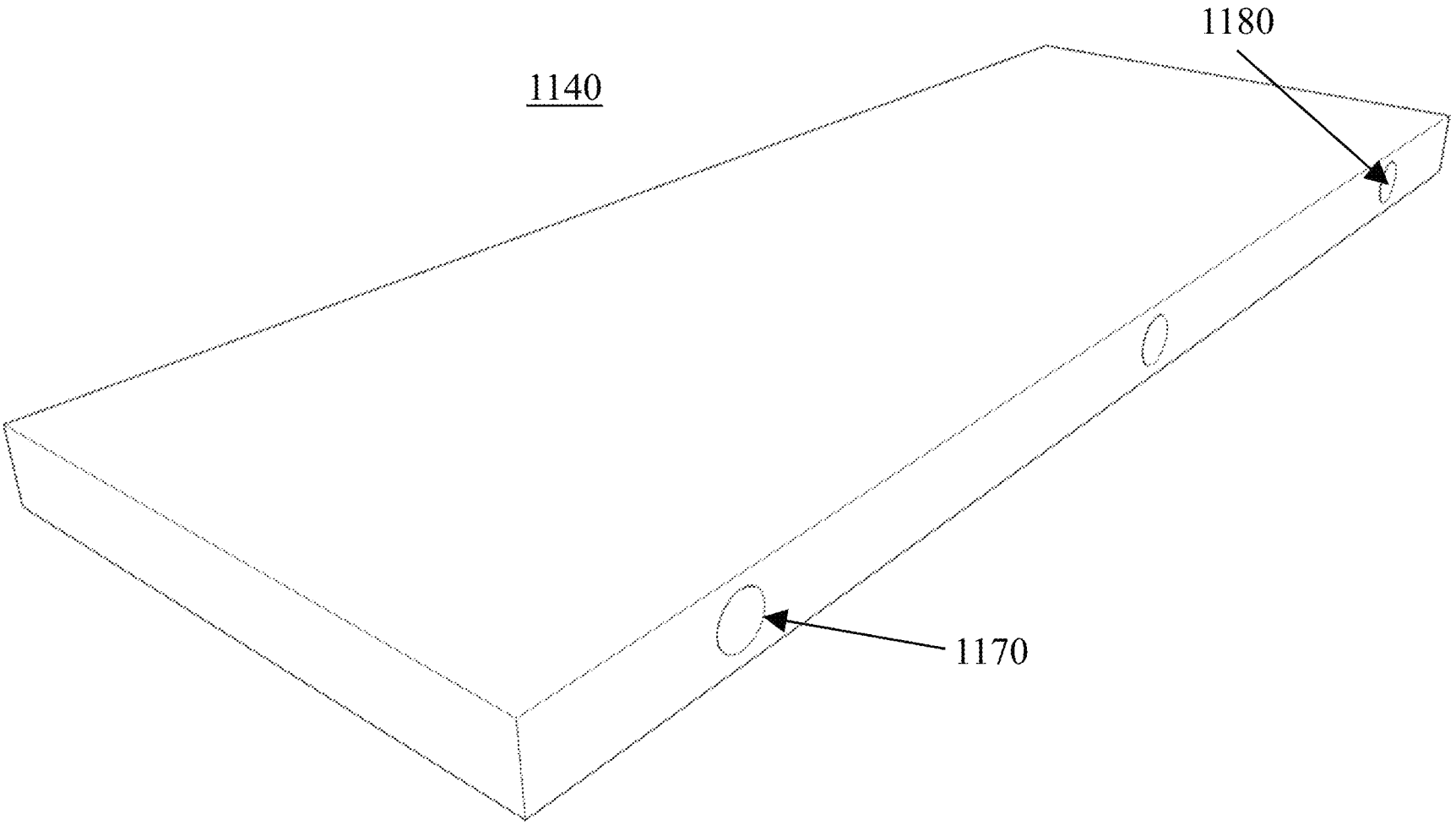
FIG. 8 is a perspective view of an exemplary embodiment of a game board segment.
Figure 9:
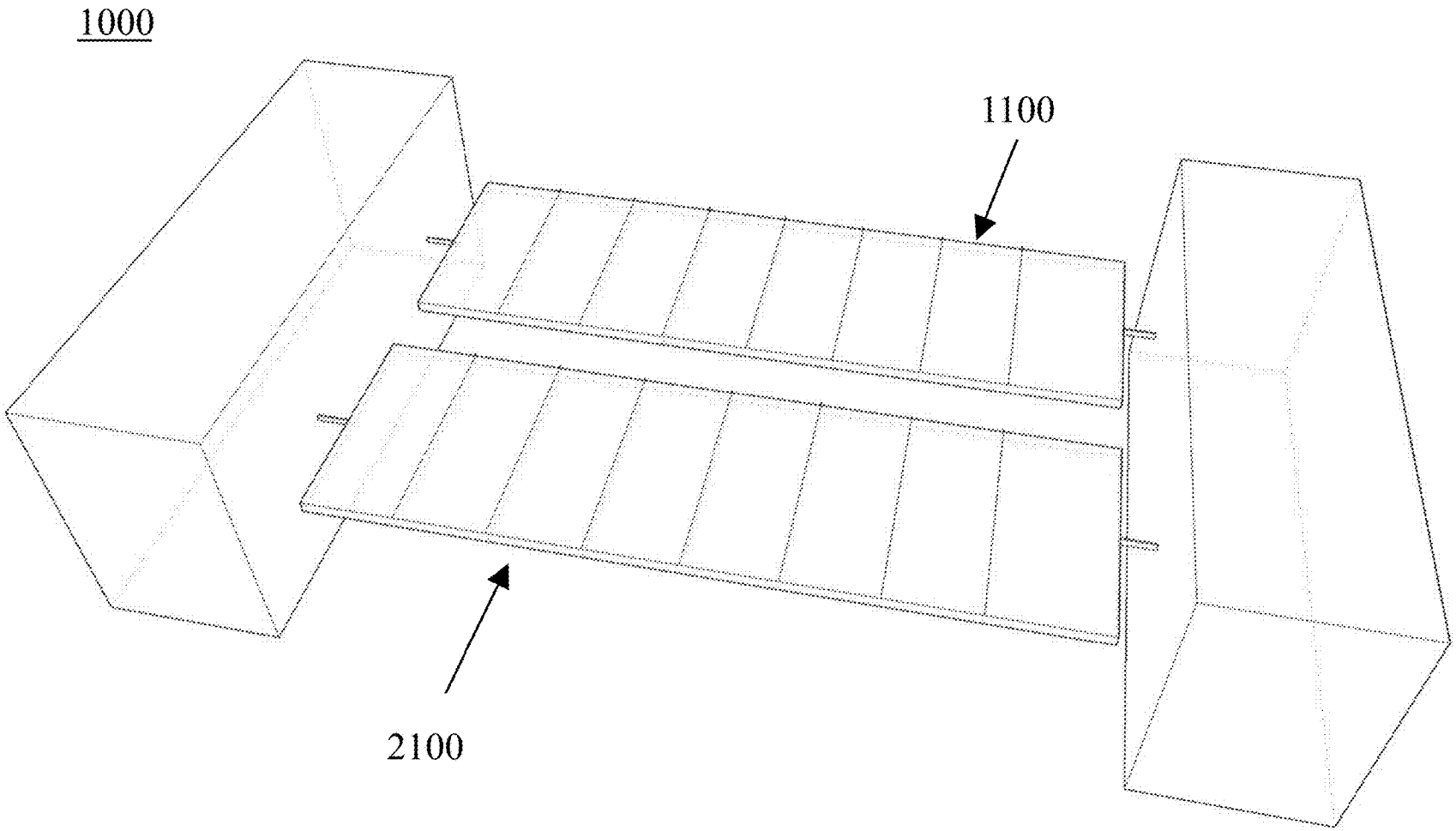
FIG. 9 is a perspective view of an exemplary embodiment of a system.
Figure 10:
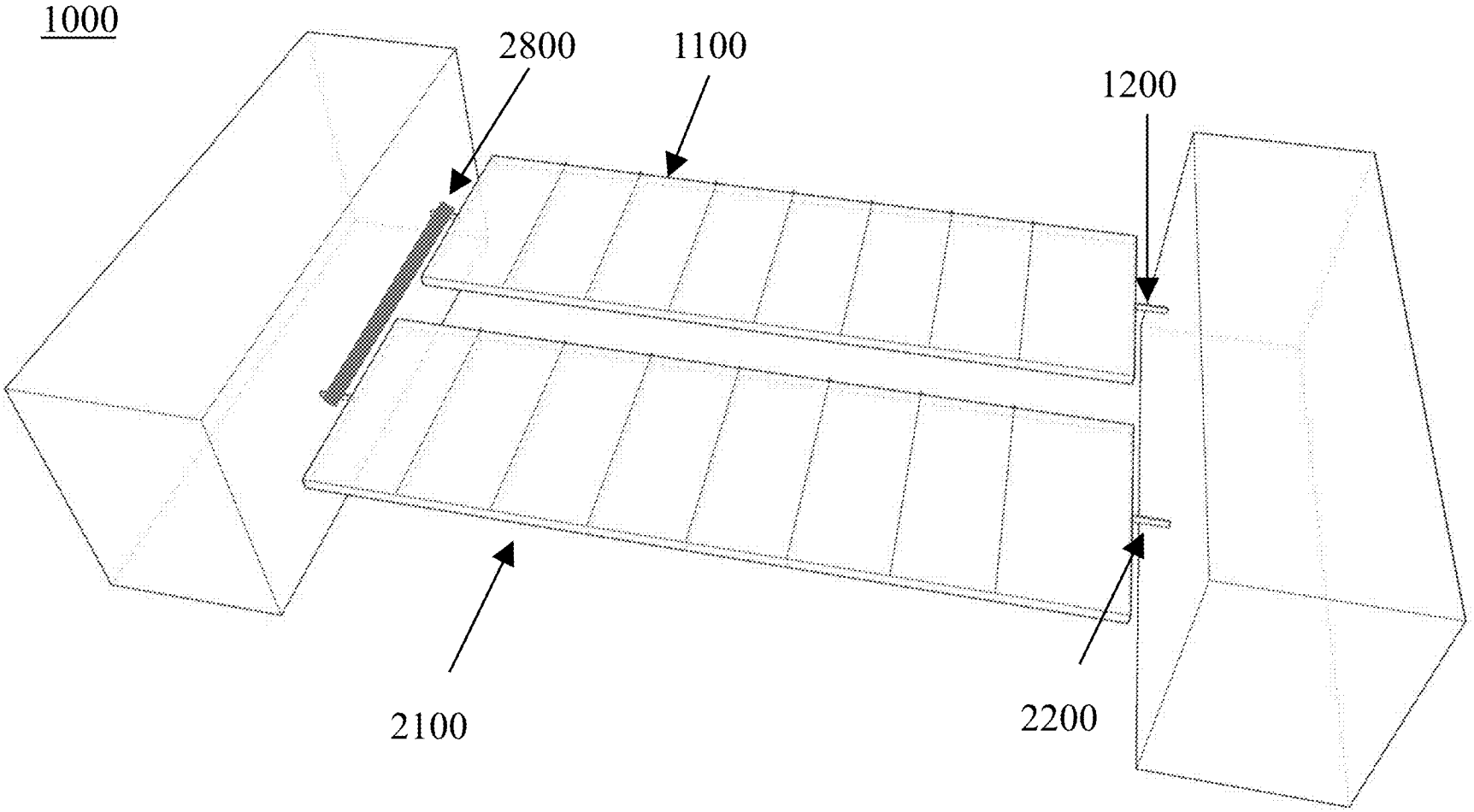
FIG. 10 is a perspective view of an exemplary embodiment of a system.
Figure 11:
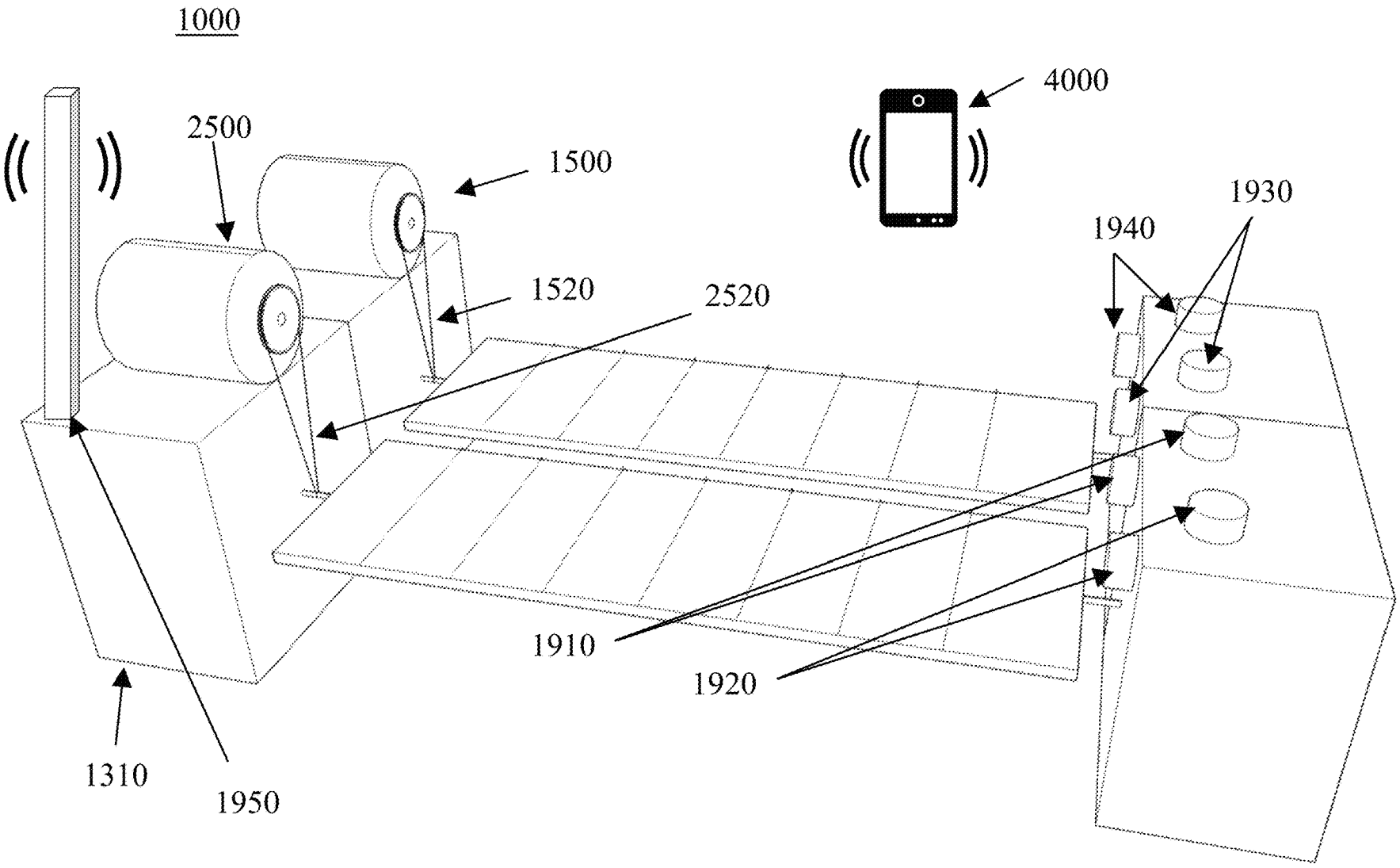
FIG. 11 is a perspective view of an exemplary embodiment of a system.
Figure 12:
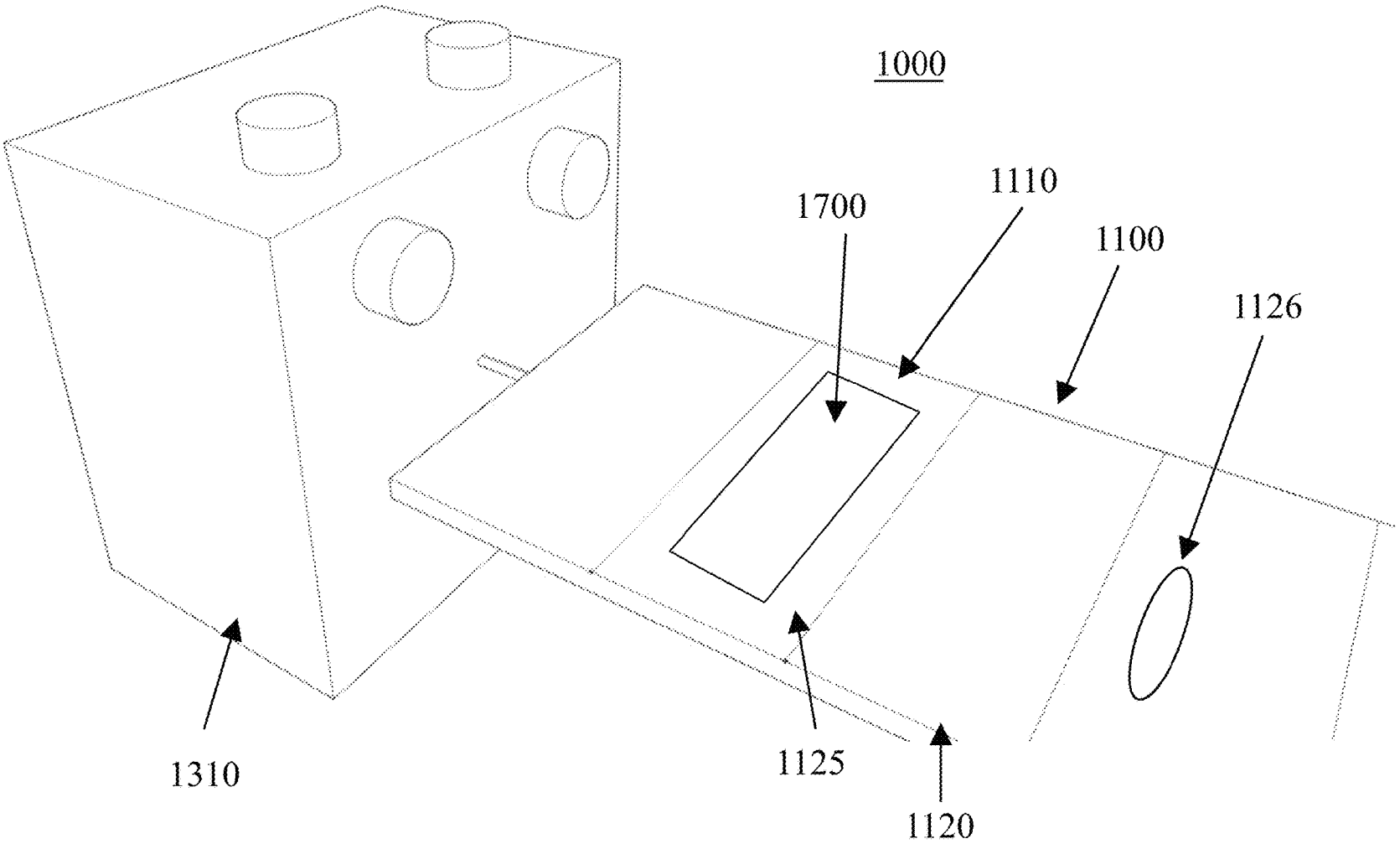
FIG. 12 is a partial perspective view of an exemplary embodiment of a system.

| Element Name | Element Number |
|---|---|
| Game system | 1000 |
| Game board | 1100 |
| Playing surface | 1110, 1120 |
| Game square | 1125 |
| Square light | 1126 |
| Board segment | 1130,1140 |
| Segment protrusion | 1150, 1160 |
| Segment receiver | 1170, 1180 |
| Slot | 1191, 1192 |
| Axle | 1200 |
| Rotational axis | 1220 |
| Support | 1310, 1320 |
| Bearing surface | 1400 |
| Motor | 1500 |
| Drive belt | 1520 |

-continued

Drawing Key

| Element Name | Element Number |
|---|---|
| Game piece - compound | 1600 |
| Game piece - single realm non-magnetic | 1610, 1620 |
| Game piece connector | 1630 |
| Game piece - single realm magnetic | 1650, 1660 |
| Game piece - magnet connector | 1670 |
| Sensor | 1700 |
| Light | 1910 |
| Display | 1920 |
| Actuator | 1930 |
| Speaker | 1940 |
| Antenna | 1950 |
| Game board | 2100 |
| Playing surface | 2110, 2120 |
| Slot | 2191, 2192 |
| Axle | 2200 |
| Rotational axis | 2220 |
| Support | 2310, 2320 |
| Motor | 2500 |
| Drive belt | 2520 |
| Axle synchronizer | 2800 |
| Information device | 4000 |

DESCRIPTION

Referring to FIGS. 1-12, a wide but non-comprehensive variety of exemplary embodiments of a board game assembly and/or system 1000, and/or potential components thereof, is presented. Board games can be limited to a single realm of play by the use of a board laid flat on a playing surface with the game pieces limited to using only the single, upward-facing, major side of the board at a given time, that single side presenting a single gaming realm and/or context.

Via certain exemplary embodiments, that limitation can be overcome by elevating board 1100 such that both major sides and/or playing surfaces 1110, 1120 of board 1100 can become accessible, such as by running an elevated rod through the length of board 1100, rod 1200 serving as an axle that allows board 1100 to be rotated and/or flipped so that play can occur, potentially simultaneously, on either side 1110, 1120 of board 1100. That is, by elevating and mounting board 1100 horizontally, such as between two posts and/or supports 1310, 1320 via a single rod 1200 running through the length of board 1100, thereby putting board 1100 on a substantially horizontal rotational axis R-R, board 1100 can be easily rotated and/or flipped about axis R-R such that both major sides 1100, 1120 can be easily accessed for gameplay.

Consistent with this general concept, certain exemplary embodiments can provide a non-destructively separable compound game piece 1600, which can allow simultaneous gameplay in two realms, can be formed by connecting two single-realm magnetic game pieces 1650, 1660 to each other via attached and/or integral magnets 1670 arranged such that the magnets can be attracted to each other through board 1100. Alternatively, a non-destructively separable compound game piece 1600, which is capable of simultaneous gameplay in two realms, can be formed from two single-realm non-magnetic game pieces 1610, 1620 that can be mechanically connected to each other, such as via, at, and/or near a connection portion 1630 that can extend through a cut slot 1191, 1192 in board 1100. Alternatively, an integral, unitary, and/or monolithic compound game piece 1600, capable of simultaneous gameplay in two realms, can define two single-realm game pieces 1610, 1620 that are joined by a connector portion 1630 that can extend through a cut slot 1191, 1192 in board 1100, the single-realm game pieces 1610, 1620 only destructively separable from one another.

In certain exemplary embodiments, slot 1191, 1192 can run all or any portion of the length of board 1100, in any event allowing for each compound game piece 1600 to move on both sides 1110, 1120 of board 1100 simultaneously, which in turn can allow game play to occur simultaneously in two realms (each side 1110, 1120 presenting its own realm) that might or might not be related to each other. Although slot 1191, 1192 can be parallel to axis R-R and/or extending solely longitudinally along board 1100, it need not, and instead can traverse a substantial portion of the length of board 1100 along any predetermined and/or segment-dependent path. That is, as slot 1191, 1192 can include curves, zigzags, undulations, reverses, bypasses, branches, switches, dead-ends, and/or cross-overs between slot 1191 and slot 1192, etc.

Similarly, note that in certain exemplary embodiments, the playing surface 1110, 1120 can present one or more graphics and/or a plurality of game squares, either of which collectively can present a path for one or more game pieces 1600, 1610, 1620, 1650, 1660 to travel. Although it can, such a path need not extend the entirety of board 1100, follow a straight line that's parallel to axis R-R. Instead, the path can curve, loop back, turn corners, intersect with other paths, Additional sides and/or realms can be provided by attaching an axle synchronizer 2800, which can comprise a gear, chain, transmission, coupling, pulley, and/or belt, etc., to axle 1200 and/or axle 2200, the axle synchronizer 2800 physically linking (and thereby synchronizing movement of) axle 1200 to one or more additional axles 2200 that each has its own rotating/flipping board 2100 attached, each additional board 2100 having one or two gaming sides 2110, 2120, thereby allowing simultaneous game play (at least for realm change) in/on 3, 4, or more realms/sides 1110, 1120, 2110, 2120. The shafts 1200, 2200 can be oriented, for example, along a line, in parallel, as spokes emanating from a common (actual or imaginary) hub, and/or in the shape of a polygon, e.g., a triangle, rhombus, etc. Alternatively, a controller can signal and/or control the timing of when motor-driven and/or non-manually actuated axles are rotated, which can be simultaneously or non-simultaneously.

With this concept in mind, certain exemplary game assemblies/systems 1000 can include, for example:

- two posts 1310, 1320, which, for example, can be sized approximately 4 inches high by approximately 6 inches thick by approximately 9 inches long, and/or can be formed from, e.g., a soft rubber and/or foam and/or a dense cardboard;
- a playing surface 1110, 1120 and/or board 1100 (comprising multiple game "squares" 1125 (that need not have 4 sides or sides of equal lengths)), which, for example, can be sized approximately 20 inches long by approximately 3 inches wide by approximately ¼ inch thick, can constructed of a relatively lightweight but durable material, such as foam board, cardboard, plastic, and/or metal, and/or can present text, graphics, animation, visual effects, sounds effects, etc. that can define a gameplay realm;
- a single approximately 0.125 inch diameter rod 1200, formed of, e.g., plastic or metal, attached to and running any portion of the length (or even the entire length) of board 1100/playing surface 1110, 1120 for a sufficient distance (for example, approximately 1 inch) beyond each end of board 1100 to connect to posts 1310, 1320 (e.g., approximately 22 inches in total length) at an elevation (e.g., approximately 4 inches) above any bearing surface 1400 (e.g., a table or floor) upon which posts 1310, 1320 bear and/or via any appropriate mechanical connection, fitting, and/or through-hole that allows rod 1200 and/or board 1100 to freely rotate about its horizontal rotational axis yet have their weight supported by posts 1310, 1320 bearing upon the support surface 1400; and/or One or more compound game piece 1600 can be, for example, approximately 3 total inches long from top to bottom, split (either physically and/or conceptually) in half to define two single realm game pieces 1610 and 1620 and/or 1650 and 1660. Magnetic single realm game pieces 1650, 1650 that define a compound game piece 1600 can be held together via magnets 1670 on one end of each game piece 1650, 1650. Non-magnetic single realm game pieces 1610, 1620 that define a compound game piece 1600 can be held together via a mechanical connector 1630 that utilizes, e.g., one or more threads, clips, detents, hook & loop material, adhesives, latches, clasps, and/or joinable "arms", etc. Alternatively, a joined game piece 1600 can be formed from a single monolithic object that defines two opposing game piece portions 1610, 1620 that are joined by a slightly thinner center portion 1630 that is dimensioned to extend through and/or be secured by slot 1191, 1190 in board 1100.

Certain exemplary embodiments of game assembly/system 1000 can include one or more additional game components (e.g., instructional board "squares"/locations/landing spaces, instructional cards, dice, spinner, etc.) that can dictate movement of one or more compound game pieces 1600 and/or when rotation/flipping of board 1100 from one realm to another is allowed.

Certain exemplary embodiments of game assembly/system 1000 can provide for board 1100 to be rotated and/or flipped in any manner, such as manually, via a wind-up spring, and/or via a motor 1500, which can be energized in response to activation of an actuator 1930, such as a button, switch, relay, etc., which can be wirelessly connected to and/or activated by an information device 4000. The rotation and/or flipping of board 1100 can occur randomly, periodically, incrementally, and/or in immediate and/or delayed reaction to an event, such as a compound game piece 1600 and/or a single-realm game piece 1610, 1620, 1650, 1660 landing on a given square 1125, passing and/or being in proximity of a predetermined board location, the occurrence of a particular instruction, etc. When rotated, board 1100 need not be rotated 180 degrees, but instead can be rotated an amount that is predetermined, random, and/or instructed. For example, the assembly/system 1000 might allow for board 1100 to be rotated any multiple of a predetermined number of degrees (e.g., 30, 45, 60, 90, 120, 180, etc. degrees), the precise multiple determined algorithmically, randomly, and/or as instructed.

In certain exemplary embodiments, board 1100 can be made of multiple materials. For example, certain portions of board 1100 could be formed from a material that obstructs/insulates a magnetic field such that, to avoid falling off the board 1100, a game piece 1600 must navigate around that material/obstruction, otherwise it might have to start game progression over.

Via certain exemplary embodiments, support 1310, board 1100, and/or playing surface 1110, 1120 can define landing spaces and/or squares 1125 that can be equipped with lighting options 1126 that can blink and/or turn on/off at predetermined times and/or sequences and/or during random intervals to impact gameplay and/or one or more game pieces 1600. Board 1100 can be equipped to run a switchable current through it, such that when the current is halted or started, the magnets 1670 release briefly. Game assembly/system 1000 can include a buzzer that beeps faster to indicate a possible flip of board 1100 or as a countdown to an imminent event. Game assembly/system 1000 can include a dice, spinner, timer (sand or electric), tokens, and/or cards.

Certain exemplary embodiments of game assembly/system 1000 can utilize the capabilities of a smartphone 4000 to provide gameplay instructions and/or to manipulate movement of board 1100 and/or one or more game pieces 1600. For example, by responding correctly to a question/statement/event written on an app running on smartphone 4000, a player's (or opponent's) game piece 1600 could be caused to move forward or backward the appropriate number of spaces 1125 without human contact.

Certain exemplary embodiments of game assembly/system 1000 can make use of written instructions, numbers on a dice, instructions on a spinner, etc., those instructions dictating, e.g., the movement of one or more boards 1100, 2100 and/or the movement of one or more game pieces 1600, such as forward, backward, and/or to a designated space/square 1125 on board 1100.

In certain exemplary embodiments of game assembly/system 1000, boards 1100, 2100 can be removable/exchangeable for the introduction to a new realm/context. Likewise, a board 2100 can be added to an additional assembly/system 1000 if an additional post 1310, 1320 is introduced, so the game play is extended in length and/or time. This can be done by creating a straight line or by affixing game boards 1100, 2100 and posts 1310, 1320 into a polygonal arrangement (e.g., triangle, square, rhombus, etc.), of which the sides can be equal in length or non-equal in length (if boards 1100, 2100 of different lengths are used).

Via certain exemplary embodiments, components attached to board 1100 can interact with human senses, such as sound, touch, taste, and/or smell. A sensor 1700 (such as a motion, proximity, and/or magnetic sensor coupled to a speaker 1940) can be added to board 1100 so that, for example, when a magnetic single-realm game piece 1650, 1660 slides over a particular location, a speaker 1940 can generate a sound, a light 1910 can be illuminated, and/or a display 1920 can render a writing, image, animation, video, etc., that can instruct and/or affect game play.

Certain exemplary embodiments of game assembly/system 1000 can utilize a metal board 1100 with magnetic single-realm game pieces 1650, 1660 that each can be moved independently of each other. That is, single realm game pieces 1650 and 1660 and/or 1610 and 1620 need not be connected (magnetically or mechanically) through board 1100, 2100. With this approach, the object of gameplay can be to achieve a goal on both sides of board 1100 independently.

In certain exemplary embodiments, game assembly/system 1000 can include a mirror that is positioned below board 1100 so that players can see both oppositely facing playing surfaces 1110 and 1120 at the same time. Game assembly/system 1000 can include, in certain exemplary embodiments, a clock that can move forward and/or backward in time. Game assembly/system 1000 can include a device that plays one or more songs and/or sounds, such as via speaker 1940, such as when certain goals are achieved.

A given player and/or team can be allotted one or more compound and/or single realm game pieces 1600, 1610, 1620, 1650, 1660 that can be played simultaneously and/or sequentially. Compound and/or single realm game pieces 1600, 1610, 1620, 1650, 1660 can be used as a team, for points, for powers, for battles, etc.

Certain exemplary embodiments of game assembly/system 1000 can include tokens and/or objects that can remain attached to board 1100 or that slide/fall off of board 1100 when board 1100, 2100 is rotated. Game assembly/system 1000 can include attachments for game pieces 1600, 1610, 1620, 1650, 1660 those attachments connectable to game piece 1600, 1610, 1620, 1650, 1660 and/or each other in a manner that when too many attachments are connected, their weight causes them and/or the game piece 1600, 1610, 1620, 1650, 1660 to which they are attached, to fall off board 1100 when board 1100 is rotated.

In certain exemplary embodiments, the board 1100 of game assembly/system 1000 can be comprised of sections or segments 1130, 1140, which can measure, for example 1" wide, 4" deep, and ⅜" thick. Each section 1130, 1140 can have a longitudinal hole through the center such that rod 1200 can extend from one side to another. Each section 1130 can have a capture system that comprises, e.g., a protrusion and/or male porti on 1150, 1160 on each end that can firmly yet non-destructively releasably nest into a receiver and/or female portion 1170, 1180 of the adjacent and/or adjoining section 1140 so that the multiple sections 1130, 1140 can be snugly connected to assemble modularly into a longer unit. If desired, multiple sections 1130, 1140 then can be "stacked" on the metal rod 1200 in any order, or rod 1200 can be inserted into multiple sections 1130, 1140 after those sections have been connected to form a longer unit, thereby creating a modular game board 1100 that, like a shish kabob, can have any of its multiple sections 1130, 1140 changed for different game sessions, thereby introducing nearly infinite variety into gameplay.

Figure 13:
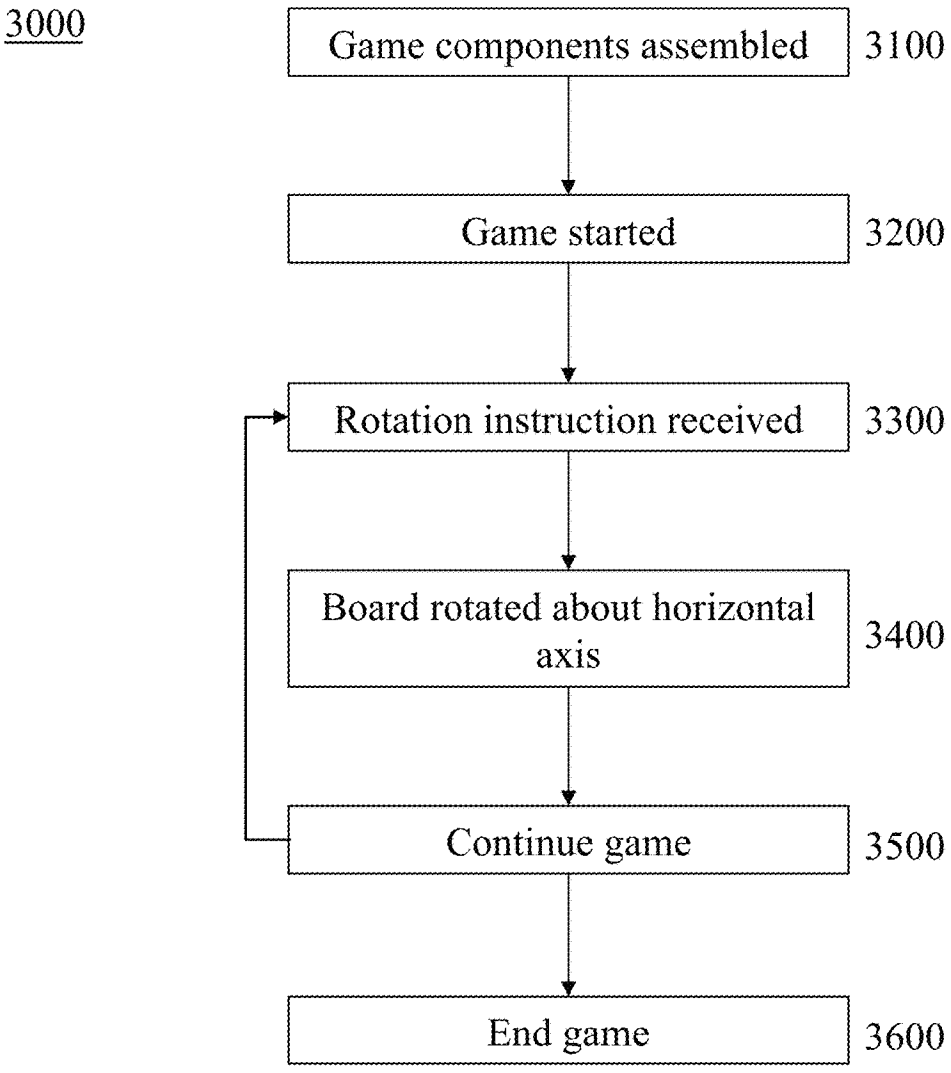
FIG. 13 is a flowchart of an exemplary embodiment of a method.

FIG. 13 is a flowchart of an exemplary embodiment of a method 3000. At activity 3100, the game components, e.g., supports, board, and pieces, etc., are assembled. At activity 3200, the game is started. At activity 3300, a rotation instruction is received, such as from a game card, spinner, information device, etc. At activity 3400, the board is rotated about the horizontal axis R-R. At activity 3500, the game is continued, potentially repeating activities 3300 and 3400, per received game instructions until, at activity 3600, the game is ended.

Figure 14:
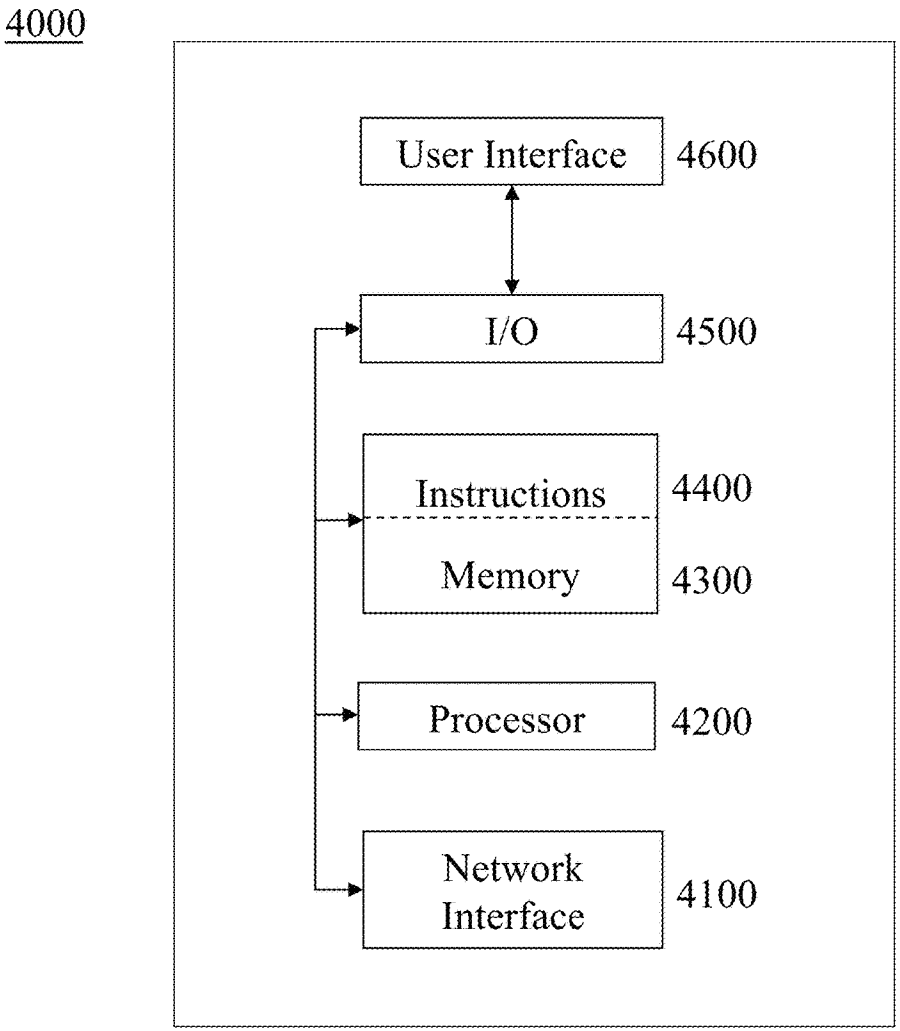
FIG. 14 is a block diagram of an exemplary embodiment of an information device.

In certain exemplary embodiments, game assembly/system 1000 can include and/or be connected, via wire and/or wirelessly (e.g., Bluetooth) to an information device 4000, which can allow game assembly/system 1000 to integrate augmented reality. FIG. 14 is a block diagram of an exemplary embodiment of information device 4000, which in certain operative embodiments can comprise, any of numerous transform circuits, which can be formed via any of numerous communicatively-, electrically-, magnetically-, optically-, fluidically-, and/or mechanically-coupled physical components, such as for example, one or more network interfaces 4100, one or more processors 4200, one or more memories 4300 containing instructions 4400, one or more input/output (I/O) devices 4500, and/or one or more user interfaces 4600 coupled to I/O device 4500, etc.

In certain exemplary embodiments, via one or more user interfaces 4600, such as a graphical user interface, a user can view a rendering of information related to researching, designing, modeling, creating, developing, making, building, manufacturing, assembling, operating, performing, using, modifying, maintaining, repairing, storing, marketing, offering for sale, selling, importing, exporting, distributing, delivering, selecting, specifying, requesting, ordering, buying, receiving, returning, rating, and/or recommending any of the systems, assemblies, devices, services, methods, user interfaces, and/or information described herein.

Certain exemplary embodiments can provide a multi-realm board game system comprising:

a elongate first game board that defines an opposing first pair of playing surfaces;

a elongate first axle extending longitudinally through the first game board and between the pair of playing surfaces, the first axle defining a substantially horizontally-extending first game board rotational axis;

a first plurality of supports configured to cooperatively support the first axle at a height about a bearing surface that is sufficient to allow the first game board to rotate a least a half revolution around the first game board rotational axis without contact between the first game board and the support surface;

a first plurality of pairs of game pieces, each pair configured to remain connected to the first game board while the first game board is rotated the at least a half revolution around the first game board rotational axis;

a first sensor integrated into the first game board and configured to signal an occurrence of a first predetermined event involving the first game board and/or one or more pairs of game pieces from the first plurality of pairs of game pieces;

a first board motor configured to rotate the first game board a predetermined degree of rotation about the first game board rotational axis.

a elongate second game board that defines an opposing second pair of playing surfaces;

an elongate second axle extending longitudinally through a second game board and between an opposing second pair of playing surfaces, the second axle defining a second game board rotational axis;

an elongate second axle extending longitudinally through a second game board and between an opposing second pair of playing surfaces, the second axle defining a substantially horizontally-extending second game board rotational axis that is non-parallel with the first game board rotational axis; and/or an elongate second axle extending longitudinally through a second game board and between an opposing second pair of playing surfaces, the second axle defining a second game board rotational axis, movement of the second axle synchronized with movement of the first axle.

wherein:

each pair of game pieces from the first plurality of pairs of game pieces is configured for a first game play on the first playing surface of the first pair of playing surfaces simultaneously with a second game play on the second playing surface of the first pair of playing surfaces;

the first game board defines a first slot configured to guide movement of the first plurality of pairs of game pieces with respect to the first game board;

the first game board defines a first slot configured to operably constrain movement of the first plurality of pairs of game pieces to a direction substantially parallel to the rotational axis;

the first game board comprises a first plurality of segments, each segment from the first plurality of segments configured to non-destructively detachably attach to another segment from the first plurality of segments;

the first game board comprises a first rearrangeable sequence of board segments;

each pair of game pieces from the first plurality of pairs of game pieces is non-destructively removeable from the first game board;

for each pair of game pieces from the first plurality of pairs of game pieces, a first game piece is integral with a second game piece;

for each pair of game pieces from the first plurality of pairs of game pieces, a first game piece is configured to be non-destructively releasably connected with a second game piece;

for each pair of game pieces from the first plurality of pairs of game pieces, a first piece is configured to be magnetically connected with a second other game piece;

for each pair of game pieces from the first plurality of pairs of game pieces, a first game piece is configured to be threadably connected with a second game piece;

the first game board is configured to cause a selective non-destructive release of a connection between the first game board and at least one game piece from at least one pair of game pieces from the first plurality of pairs of game pieces;

the first plurality of supports is configured to cooperatively support a second axle at a height sufficient to allow a second game board to rotate at least a half revolution around a second game board rotational axis without contact between the second game board and the support surface; and/or each playing surface of the first pair of playing surfaces is configured for game play in a corresponding realm.

Definitions

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

about—around and/or approximately.

above—at a higher level.

across—from one side to another.

activity—an action, act, step, and/or process or portion thereof.

adapt—to design, make, set up, arrange, shape, configure, and/or make suitable and/or fit for a specific purpose, function, use, and/or situation.

adapter—a device used to effect operative compatibility between different parts of one or more pieces of an apparatus or system.

after—following in time and/or subsequent to.

allow—to provide, let do, happen, and/or permit.

along—through, on, beside, over, in line with, and/or parallel to the length and/or direction of; and/or from one end to the other of.

an—at least one.

and—in conjuction with.

and/or—either in conjunction with or in alternative to.

another—an additional one.

any—one, some, every, and/or all without specification.

apparatus—an appliance or device for a particular purpose.

approximately—about and/or nearly the same as.

around—approximately; in all directions from a point of reference; about, surrounding, and/or on substantially all sides of on one or more sides.

as long as—if and/or since.

associate—to join, connect together, and/or relate.

at—in, on, and/or near.

at least—not less than, and possibly more than.

attach—to join, connect, secure, link, or fasten together.

automatic—performed via an information device in a manner essentially independent of influence and/or control by a user. For example, an automatic light switch can turn on upon "seeing" a person in its "view", without the person manually operating the light switch.

axis—a straight line about which a body and/or geometric object rotates and/or can be conceived to rotate and/or a center line to which parts of a structure and/or body can be referred.

axle—a shaft having a rotational axis about which an object rotates.

bearing—something that supports weight.

between—in a separating interval and/or intermediate to.

board—a typically flat, planar, rigid, and/or relatively thin piece of material on which a game is played.

board game—a game that is played on a specially-designed board and usually involves moving pieces along and/or on the board.

by—via and/or with the use and/or help of.

can—is capable of, in at least some embodiments.

cause—to bring about, provoke, precipitate, produce, elicit, be the reason for, result in, and/or effect.

circuit—a physical system comprising, depending on context: an electrically conductive pathway, an information transmission mechanism, and/or a communications connection, the pathway, mechanism, and/or connection established via a switching device (such as a switch, relay, transistor, and/or logic gate, etc.); and/or an electrically conductive pathway, an information transmission mechanism, and/or a communications connection, the pathway, mechanism, and/or connection established across two or more switching devices comprised by a network and between corresponding end systems connected to, but not comprised by the network.

compound game piece—a game piece composed of, created by, and/or defining a combination of two or more parts, elements, logical portions, etc., such as two or more single-realm game pieces connectable and/or joined via a connector portion.

composition of matter—a combination, reaction product, compound, mixture, formulation, material, and/or composite formed by a human and/or automation from two or more substances and/or elements.

comprising—including but not limited to.

conceive—to imagine, conceptualize, form, and/or develop in the mind.

configure—to design, arrange, set up, shape, and/or make suitable and/or fit for a specific purpose, function, use, and/or situation.

connect—to join, link, secure, and/or fasten together.

connectable—made suitable and/or fit for joining, linking, securing, and/or fastening together.

constrain—to restrict, limit, regulate, and/or restrain within bounds.

contact—to physically touch and/or come together.

containing—including but not limited to.

convert—to transform, adapt, and/or change.

cooperatively—in concert with and/or in a sharing manner.

corresponding—related, associated, accompanying, similar in purpose and/or position, conforming in every respect, and/or equivalent and/or agreeing in amount, quantity, magnitude, quality, and/or degree.

coupleable—capable of being joined, connected, and/or linked together.

coupling—linking in some fashion.

create—to bring into being.

data—distinct pieces of information, usually formatted in a special or predetermined way and/or organized to express concepts, and/or represented in a form suitable for processing by an information device.

define—to establish the meaning, relationship, outline, form, and/or structure of; and/or to precisely and/or distinctly describe and/or specify.

degree—a unit of angular measure equal in magnitude to 1/360 of a complete revolution in a predetermined plane.

derive—to receive, obtain, and/or produce from a source and/or origin.

detach—to separate, remove, unfasten, disconnect, and/or unattach.

determine—to find out, obtain, calculate, decide, deduce, ascertain, and/or come to a decision, typically by investigation, reasoning, and/or calculation.

device—a machine, manufacture, and/or collection thereof.

digital—non-analog and/or discrete.

direction—a spatial relation between something and a course along which it points and/or moves; a distance independent relationship between two points in space that specifies the position of either with respect to the other; and/or a relationship by which the alignment and/or orientation of any position with respect to any other position is established.

each—every one of a group considered individually.

effective—sufficient to bring about, provoke, elicit, and/or cause.

elongate—drawn out, made spatially longer, and/or having more length than width.

embodiment—an implementation, manifestation, and/or concrete representation.

estimate—(n) a calculated value approximating an actual value; (v) to calculate and/or determine approximately and/or tentatively.

event—an occurrence and/or happening.

exemplary—serving as an example, instance, and/or illustration.

extending—existing, located, placed, and/or stretched lengthwise.

first—an initial cited element of a set.

for—with a purpose of.

from—used to indicate a source, origin, and/or location thereof.

further—in addition.

game—an amusement and/or competitive activity involving skill, chance, and/or endurance on the part of one or more persons who play according to a set of rules.

game piece—an object used in playing a board game by movement of that object on, along, and/or with respect to the board.

generate—to create, produce, give rise to, and/or bring into existence.

guide—to direct, steer, and/or exert control and/or influence over.

half—approximately fifty percent.

haptic—involving the human sense of kinesthetic movement and/or the human sense of touch. Among the many potential haptic experiences are numerous sensations, body-positional differences in sensations, and time-based changes in sensations that are perceived at least partially in non-visual, non-audible, and non-olfactory manners, including the experiences of tactile touch (being touched), active touch, grasping, pressure, friction, traction, slip, stretch, force, torque, impact, puncture, vibration, motion, acceleration, jerk, pulse, orientation, limb position, gravity, texture, gap, recess, viscosity, pain, itch, moisture, temperature, thermal conductivity, and thermal capacity.

having—including but not limited to.

height—a measurement of the extent of something along an, often substantially vertical, dimension.

human-machine interface—hardware and/or software adapted to render information to a user and/or receive information from the user; and/or a user interface.

including—including but not limited to.

information device—any device capable of processing data and/or information, such as any general purpose and/or special purpose computer, such as a personal computer, workstation, server, minicomputer, mainframe, supercomputer, computer terminal, laptop, tablet computer (such as an iPad-like device), wearable computer, Personal Digital Assistant (PDA), mobile terminal, Bluetooth device, communicator, "smart" phone (such as an iPhone-like device), messaging service (e.g., Blackberry) receiver, pager, facsimile, cellular telephone, traditional telephone, telephonic device, embedded controller, programmed microprocessor or microcontroller and/or peripheral integrated circuit elements, ASIC or other integrated circuit, hardware electronic logic circuit such as a discrete element circuit, and/or programmable logic device such as a PLD, PLA, FPGA, or PAL, or the like, etc. In general, any device on which resides a finite state machine capable of implementing at least a portion of a method, structure, and/or or graphical user interface described herein may be used as an information device. An information device can comprise components such as one or more network interfaces, one or more processors, one or more memories containing instructions, and/or one or more input/output (I/O) devices, one or more user interfaces coupled to an I/O device, etc. In information device can be a component of and/or augment another device, such as an appliance, machine, tool, robot, vehicle, television, printer, "smart" utility meter, etc.

initialize—to prepare something for use and/or some future event.

input/output (I/O) device—any device adapted to provide input to, and/or receive output from, an information device. Examples can include an audio, visual, haptic, olfactory, and/or taste-oriented device, including, for example, a monitor, display, projector, overhead display, keyboard, keypad, mouse, trackball, joystick, gamepad, wheel, touchpad, touch panel, pointing device, microphone, speaker, video camera, camera, scanner, printer, switch, relay, haptic device, vibrator, tactile simulator, and/or tactile pad, potentially including a port to which an I/O device can be attached or connected.

install—to connect or set in position and prepare for use.

instructions—directions, which can be implemented as hardware, firmware, and/or software, the directions adapted to perform a particular operation and/or function via creation and/or maintenance of a predetermined physical circuit.

integral—formed and/or united into another entity.

integrated—formed and/or united into a whole or into another entity.

into—to a condition, state, or form of; toward, in the direction of, and/or to the inside of.

involve—to include, relate to, have an effect on, and/or entail.

is—to exist in actuality.

logic gate—a physical device adapted to perform a logical operation on one or more logic inputs and to produce a single logic output, which is manifested physically. Because the output is also a logic-level value, an output of one logic gate can connect to the input of one or more other logic gates, and via such combinations, complex operations can be performed. The logic normally performed is Boolean logic and is most commonly found in digital circuits. The most common implementations of logic gates are based on electronics using resistors, transistors, and/or diodes, and such implementations often appear in large arrays in the form of integrated circuits (a.k.a., IC's, microcircuits, microchips, silicon chips, and/or chips). It is possible, however, to create logic gates that operate based on vacuum tubes, electromagnetics (e.g., relays), mechanics (e.g., gears), fluidics, optics, chemical reactions, and/or DNA, including on a molecular scale. Each electronically-implemented logic gate typically has two inputs and one output, each having a logic level or state typically physically represented by a voltage. At any given moment, every terminal is in one of the two binary logic states ("false" (a.k.a., "low" or "0") or "true" (a.k.a., "high" or "1"), represented by different voltage levels, yet the logic state of a terminal can, and generally does, change often, as the circuit processes data. Thus, each electronic logic gate typically requires power so that it can source and/or sink currents to achieve the correct output voltage. Typically, machine-implementable instructions are ultimately encoded into binary values of "0"s and/or "1"s and, are typically written into and/or onto a memory device, such as a "register", which records the binary value as a change in a physical property of the memory device, such as a change in voltage, current, charge, phase, pressure, weight, height, tension, level, gap, position, velocity, momentum, force, temperature, polarity, magnetic field, magnetic force, magnetic orientation, reflectivity, molecular linkage, molecular weight, etc. An exemplary register might store a value of "01101100", which encodes a total of 8 "bits" (one byte), where each value of either "0" or "1" is called a "bit" (and 8 bits are collectively called a "byte"). Note that because a binary bit can only have one of two different values (either "0" or "1"), any physical medium capable of switching between two saturated states can be used to represent a bit. Therefore, any physical system capable of representing binary bits is able to represent numerical quantities, and potentially can manipulate those numbers via particular encoded machine-implementable instructions. This is one of the basic concepts underlying digital computing. At the register and/or gate level, a computer does not treat these "0"s and "1"s as numbers per se, but typically as voltage levels (in the case of an electronically-implemented computer), for example, a high voltage of approximately +3 volts might represent a "1" or "logical true" and a low voltage of approximately 0 volts might represent a "0" or "logical false" (or vice versa, depending on how the circuitry is designed). These high and low voltages (or other physical properties, depending on the nature of the implementation) are typically fed into a series of logic gates, which in turn, through the correct logic design, produce the physical and logical results specified by the particular encoded machine-implementable instructions. For example, if the encoding request a calculation, the logic gates might add the first two bits of the encoding together, produce a result "1" ("0"+"1"="1"), and then write this result into another register for subsequent retrieval and reading. Or, if the encoding is a request for some kind of service, the logic gates might in turn access or write into some other registers which would in turn trigger other logic gates to initiate the requested service.

logical—a conceptual representation.

longitudinal—of and/or relating to a length; placed and/or running lengthwise.

machine-implementable instructions—directions adapted to cause a machine, such as an information device, to perform one or more particular activities, operations, and/or functions via forming a particular physical circuit. The directions, which can sometimes form an entity called a "processor", "kernel", "operating system", "program", "application", "utility", "subroutine", "script", "macro", "file", "project", "module", "library", "class", and/or "object", etc., can be embodied and/or encoded as machine code, source code, object code, compiled code, assembled code, interpretable code, and/or executable code, etc., in hardware, firmware, and/or software.

machine-readable medium—a transitory and/or non-transitory physical and/or tangible structure via which a machine, such as an information device, computer, microprocessor, and/or controller, etc., can store or carry one or more machine-implementable instructions, data structures, data, and/or information and/or obtain one or more stored machine-implementable instructions, data structures, data, and/or information. Examples include a memory device, punch card, player-plano scroll, etc.

magnetic—having the property of attracting iron and certain other materials by virtue of a surrounding field of force.

may—is allowed and/or permitted to, in at least some embodiments.

memory device—an apparatus capable of storing, sometimes permanently, machine-implementable instructions, data, and/or information, in analog and/or digital format. Examples include at least one non-volatile memory, volatile memory, register, relay, switch, Random Access Memory, RAM, Read Only Memory, Erasable Programmable Read-Only Memory (EPROM), Electrically Erasable Programmable Read-Only Memory (EEPROM), ROM, flash memory, magnetic media, hard disk, floppy disk, magnetic tape, optical media, optical disk, compact disk, CD, digital versatile disk, DVD, and/or raid array, etc. The memory device can be coupled to a processor and/or can store and provide instructions adapted to be executed by processor, such as according to an embodiment disclosed herein.

method—one or more acts that are performed upon subject matter to be transformed to a different state or thing and/or are tied to a particular apparatus, said one or more acts not a fundamental principal and not pre-empting all uses of a fundamental principal.

more—a quantifier meaning greater in size, amount, extent, and/or degree.

motor—something that imparts motion.

movement—a change in position from one location to another; an act or instance of moving.

multi-realm—more than one realm.

near—a distance of less than approximately [X].

network—a communicatively coupled plurality of nodes, communication devices, and/or information devices. Via a network, such nodes and/or devices can be linked, such as via various wireline and/or wireless media, such as cables, telephone lines, power lines, optical fibers, radio waves, and/or light beams, etc., to share resources (such as printers and/or memory devices), exchange files, and/or allow electronic communications therebetween. A network can be and/or can utilize any of a wide variety of sub-networks and/or protocols, such as a circuit switched, public-switched, packet switched, connection-less, wireless, virtual, radio, data, telephone, twisted pair, POTS, non-POTS, DSL, cellular, telecommunications, video distribution, cable, radio, terrestrial, microwave, broadcast, satellite, broadband, corporate, global, national, regional, wide area, backbone, packet-switched TCP/IP, IEEE 802.03, Ethernet, Fast Ethernet, Token Ring, local area, wide area, IP, public Internet, intranet, private, ATM, Ultra Wide Band (UWB), Wi-Fi, BlueTooth, Airport, IEEE 802.11, IEEE 802.11a, IEEE 802.11b, IEEE 802.11g, X-10, electrical power, 3G, 4G, multi-domain, and/or multi-zone sub-network and/or protocol, one or more Internet service providers, one or more network interfaces, and/or one or more information devices, such as a switch, router, and/or gateway not directly connected to a local area network, etc., and/or any equivalents thereof.

network interface—any physical and/or logical device, system, and/or process capable of coupling an information device to a network. Exemplary network interfaces comprise a telephone, cellular phone, cellular modem, telephone data modem, fax modem, wireless transceiver, communications port, ethernet card, cable modem, digital subscriber line interface, bridge, hub, router, or other similar device, software to manage such a device, and/or software to provide a function of such a device.

no—an absence of and/or lacking any.

non-destructively—of, relating to, or being a process that does not result in damage to the subject material and/or product and/or results in such minimal damage that the subject material and/or product can be re-used for its intended purpose.

non-parallel—not parallel.

occurrence—an action, fact, and/or instance of occurring; and/or something that takes place.

one—being and/or amounting to a single unit, individual, and/or entire thing, item, and/or object.

operable—practicable and/or fit, ready, and/or configured to be put into its intended use and/or service.

opposing—opposite; against; being the other of two complementary or mutually exclusive things; and/or placed or located opposite, in contrast, in counterbalance, and/or across from something else and/or from each other.

or—a conjunction used to indicate alternatives, typically appearing only before the last item in a group of alternative items.

other—a different and/or distinct entity and/or not the same as already mentioned and/or implied.

outside—beyond a range, boundary, and/or limit; and/or not within.

packet—a generic term for a bundle of data organized in a specific way for transmission, such as within and/or across a network, such as a digital packet-switching network, and comprising the data to be transmitted and certain control information, such as a destination address.

pair—a set of two items.

parallel—of, relating to, and/or designating lines, curves, planes, and/or surfaces everywhere equidistant and/or an arrangement of components in an electrical circuit that splits an electrical current into two or more paths.

per—for each and/or by means of.

perceptible—capable of being perceived by the human senses.

physical—tangible, real, and/or actual.

physically—existing, happening, occurring, acting, and/or operating in a manner that is tangible, real, and/or actual.

piece—a component adapted to form a greater whole when combined with one or more additional pieces.

planar—shaped as a substantially flat two-dimensional surface.

play—to participate and/or take part in.

playing surface—a surface of a game board that contacts game pieces.

plurality—the state of being plural and/or more than one.

portion—a part, component, section, percentage, ratio, and/or quantity that is less than a larger whole.

power—(v) to supply with energy; (n) energy, a measure of energy and/or work, and/or a rate at which work is done, expressed as the amount of work per unit time and commonly measured in units such as watt and horsepower.

pre-—a prefix that precedes an activity that has occurred beforehand and/or in advance.

predetermine—to determine, decide, obtain, calculate, choose, select, and/or establish in advance.

prevent—to hinder, avert, and/or keep from occurring.

prior—before and/or preceding in time or order.

probability—a quantitative representation of a likelihood of an occurrence.

processor—a machine that utilizes hardware, firmware, and/or software and is physically adaptable to perform, via Boolean logic operating on a plurality of logic gates that form particular physical circuits, a specific task defined by a set of machine-implementable instructions. A processor can utilize mechanical, pneumatic, hydraulic, electrical, magnetic, optical, informational, chemical, and/or biological principles, mechanisms, adaptations, signals, inputs, and/or outputs to perform the task(s). In certain embodiments, a processor can act upon information by manipulating, analyzing, modifying, and/or converting it, transmitting the information for use by machine-implementable instructions and/or an information device, and/or routing the information to an output device. A processor can function as a central processing unit, local controller, remote controller, parallel controller, and/or distributed controller, etc. Unless stated otherwise, the processor can be a general-purpose device, such as a microcontroller and/or a microprocessor, such the Pentium family of microprocessor manufactured by the Intel Corporation of Santa Clara, Calif. In certain embodiments, the processor can be dedicated purpose device, such as an Application Specific Integrated Circuit (ASIC) or a Field Programmable Gate Array (FPGA) that has been designed to implement in its hardware and/or firmware at least a part of an embodiment disclosed herein. A processor can reside on and use the capabilities of a controller.

product—something produced by human and/or mechanical effort.

project—to calculate, estimate, or predict.

provide—to furnish, supply, give, and/or make available.

range—a measure of an extent of a set of values and/or an amount and/or extent of variation.

ratio—a relationship between two quantities expressed as a quotient of one divided by the other.

realm—an area, domain, field, and/or sphere, such as of knowledge and/or activity.

rearrange—to put something into a new and/or different order and/or sequence.

receive—to get as a signal, take, acquire, and/or obtain.

recommend—to suggest, praise, commend, and/or endorse.

reduce—to make and/or become lesser and/or smaller.

releasably—capable of being freed, in a substantially non-destructive manner, from something that binds, fastens, or holds back.

release—to let go and/or free from something that restrains, binds, fastens, and/or holds back.

remain—to stay in substantially a same location and/or state.

removable—capable of being moved from a place or position occupied.

remove—to eliminate, remove, and/or delete, and/or to move from a place or position occupied.

render—to, e.g., physically, chemically, biologically, electronically, electrically, magnetically, optically, acoustically, fluidically, and/or mechanically, etc., transform information into a form perceptible to a human as, for example, data, commands, text, graphics, audio, video, animation, and/or hyperlinks, etc., such as via a visual, audio, and/or haptic, etc., means and/or depiction, such as via a display, monitor, electric paper, ocular implant, cochlear implant, speaker, vibrator, shaker, force-feedback device, stylus, joystick, steering wheel, glove, blower, heater, cooler, pin array, tactile touchscreen, etc.

repeat—to do again and/or perform again.

repeatedly—again and again; repetitively.

request—to express a desire for and/or ask for.

result—(n.) an outcome and/or consequence of a particular action, operation, and/or course; (v.) to cause an outcome and/or consequence of a particular action, operation, and/or course.

revolution—a 360 degree rotation around an axis.

rotate—to turn around a center and/or an axis.

rotation—an act and/or process of turning around a center and/or an axis.

rotational—about and/or around an axis.

said—when used in a system or device claim, an article indicating a subsequent claim term that has been previously introduced.

second—a cited element of a set that follows an initial element.

segment—a physically-separable portion.

select—to make a choice or selection from alternatives.

selectable—capable of being chosen and/or selected.

sensor—a device adapted to automatically sense, perceive, detect, and/or measure a physical property (e.g., pressure, temperature, flow, mass, heat, light, sound, humidity, proximity, position, velocity, vibration, loudness, voltage, current, capacitance, resistance, inductance, magnetic flux, and/or electro-magnetic radiation, etc.) and convert that physical quantity into a signal. Examples include position sensors, proximity switches, stain gages, photo sensors, thermocouples, level indicating devices, speed sensors, accelerometers, electrical voltage indicators, electrical current indicators, on/off indicators, and/or flowmeters, etc.

sequence—an ordered series.

server—an information device and/or a process running thereon, that is adapted to be communicatively coupled to a network and that is adapted to provide at least one service for at least one client, i.e., for at least one other information device communicatively coupled to the network and/or for at least one process running on another information device communicatively coupled to the network. One example is a file server, which has a local drive and services requests from remote clients to read, write, and/or manage files on that drive. Another example is an e-mail server, which provides at least one program that accepts, temporarily stores, relays, and/or delivers e-mail messages. Still another example is a database server, which processes database queries. Yet another example is a device server, which provides networked and/or programmable: access to, and/or monitoring, management, and/or control of, shared physical resources and/or devices, such as information devices, printers, modems, scanners, projectors, displays, lights, cameras, security equipment, proximity readers, card readers, kiosks, POS/retail equipment, phone systems, residential equipment, HVAC equipment, medical equipment, laboratory equipment, industrial equipment, machine tools, pumps, fans, motor drives, scales, programmable logic controllers, sensors, data collectors, actuators, alarms, annunciators, and/or input/output devices, etc.

set—a related plurality.

signal—(v) to communicate; (n) one or more automatically detectable variations in a physical variable, such as a pneumatic, hydraulic, acoustic, fluidic, mechanical, electrical, magnetic, optical, chemical, and/or biological variable, such as power, energy, pressure, flowrate, viscosity, density, torque, impact, force, frequency, phase, voltage, current, resistance, magnetomotive force, magnetic field intensity, magnetic field flux, magnetic flux density, reluctance, permeability, index of refraction, optical wavelength, polarization, reflectance, transmittance, phase shift, concentration, and/or temperature, etc., that can encode information, such as machine-implementable instructions for activities and/or one or more letters, words, characters, symbols, signal flags, visual displays, and/or special sounds, etc., having prearranged meaning. Depending on the context, a signal and/or the information encoded therein can be synchronous, asynchronous, hard real-time, soft real-time, non-real time, continuously generated, continuously varying, analog, discretely generated, discretely varying, quantized, digital, broadcast, multicast, unicast, transmitted, conveyed, received, continuously measured, discretely measured, processed, encoded, encrypted, multiplexed, modulated, spread, de-spread, demodulated, detected, de-multiplexed, decrypted, and/or decoded, etc.

simultaneous—happening, existing, and/or done at substantially the same time.

single-realm game piece—a game piece adapted for play in a single, yet not necessarily defined, game realm, and/or on a single playing surface, at a time.

slot—a groove, slit, channel, and/or a narrow opening and/or aperture; and/or an opening having a longer (not necessarily straight) length than a width of the opening.

special purpose computer—a computer and/or information device comprising a processor device having a plurality of logic gates, whereby at least a portion of those logic gates, via implementation of specific machine-implementable instructions by the processor, experience a change in at least one physical and measurable property, such as a voltage, current, charge, phase, pressure, weight, height, tension, level, gap, position, velocity, momentum, force, temperature, polarity, magnetic field, magnetic force, magnetic orientation, reflectivity, molecular linkage, molecular weight, etc., thereby directly tying the specific machine-implementable instructions to the logic gate's specific configuration and property(ies). In the context of an electronic computer, each such change in the logic gates creates a specific electrical circuit, thereby directly tying the specific machine-implementable instructions to that specific electrical circuit.

special purpose processor—a processor device, having a plurality of logic gates, whereby at least a portion of those logic gates, via implementation of specific machine-implementable instructions by the processor, experience a change in at least one physical and measurable property, such as a voltage, current, charge, phase, pressure, weight, height, tension, level, gap, position, velocity, momentum, force, temperature, polarity, magnetic field, magnetic force, magnetic orientation, reflectivity, molecular linkage, molecular weight, etc., thereby directly tying the specific machine-implementable instructions to the logic gate's specific configuration and property(ies). In the context of an electronic computer, each such change in the logic gates creates a specific electrical circuit, thereby directly tying the specific machine-implementable instructions to that specific electrical circuit.

species—a class of individuals and/or objects grouped by virtue of their common attributes and assigned a common name; a division subordinate to a genus.

store—to place, hold, and/or retain data, typically in a memory.

substantially—to a considerable, large, and/or great, but not necessarily whole and/or entire, extent and/or degree.

sufficient—a degree and/or amount necessary to achieve a predetermined result.

support—(v) to hold, bear, and/or carry the weight and/or mechanical load of, especially from below; (n) a structure that bears the weight of an object to maintain that object in an operative position.

surface—the outer boundary of an object and/or a material layer constituting and/or resembling such a boundary.

switch—(v) to: form, open, and/or close one or more circuits; form, complete, and/or break an electrical and/or informational path; select a path and/or circuit from a plurality of available paths and/or circuits; and/or establish a connection between disparate transmission path segments in a network (or between networks); (n) a physical device, such as a mechanical, electrical, and/or electronic device, that is adapted to switch.

system—a collection of mechanisms, devices, machines, articles of manufacture, processes, data, and/or instructions, the collection designed to perform one or more specific functions.

that—a pronoun used to indicate a thing as indicated, mentioned before, present, and/or well known; and/or used as the subject or object of a relative clause.

thread—a helical and/or spiral ridge used for advancing a shaft in a longitudinal direction, such as found on screws, nuts, and bolts.

through—across, among, between, and/or in one side and out the opposite and/or another side of.

to—a preposition adapted for use for expressing purpose.

transform—to change in measurable: form, appearance, nature, and/or character.

transmit—to send as a signal, provide, furnish, and/or supply.

treatment—an act, manner, or method of handling and/or dealing with someone and/or something.

upon—immediately or very soon after; and/or on the occasion of.

use—to put into service.

user interface—any device for rendering information to a user and/or requesting information from the user. A user interface includes at least one of textual, graphical, audio, video, animation, and/or haptic elements. A textual element can be provided, for example, by a printer, monitor, display, projector, etc. A graphical element can be provided, for example, via a monitor, display, projector, and/or visual indication device, such as a light, flag, beacon, etc. An audio element can be provided, for example, via a speaker, microphone, and/or other sound generating and/or receiving device. A video element or animation element can be provided, for example, via a monitor, display, projector, and/or other visual device. A haptic element can be provided, for example, via a very low frequency speaker, vibrator, tactile stimulator, tactile pad, simulator, keyboard, keypad, mouse, trackball, joystick, gamepad, wheel, touchpad, touch panel, pointing device, and/or other haptic device, etc. A user interface can include one or more textual elements such as, for example, one or more letters, number, symbols, etc. A user interface can include one or more graphical elements such as, for example, an image, photograph, drawing, icon, window, title bar, panel, sheet, tab, drawer, matrix, table, form, calendar, outline view, frame, dialog box, static text, text box, list, pick list, pop-up list, pull-down list, menu, tool bar, dock, check box, radio button, hyperlink, browser, button, control, palette, preview panel, color wheel, dial, slider, scroll bar, cursor, status bar, stepper, and/or progress indicator, etc. A textual and/or graphical element can be used for selecting, programming, adjusting, changing, specifying, etc. an appearance, background color, background style, border style, border thickness, foreground color, font, font style, font size, alignment, line spacing, indent, maximum data length, validation, query, cursor type, pointer type, autosizing, position, and/or dimension, etc. A user interface can include one or more audio elements such as, for example, a volume control, pitch control, speed control, voice selector, and/or one or more elements for controlling audio play, speed, pause, fast forward, reverse, etc. A user interface can include one or more video elements such as, for example, elements controlling video play, speed, pause, fast forward, reverse, zoom-in, zoom-out, rotate, and/or tilt, etc. A user interface can include one or more animation elements such as, for example, elements controlling animation play, pause, fast forward, reverse, zoom-in, zoom-out, rotate, tilt, color, intensity, speed, frequency, appearance, etc. A user interface can include one or more haptic elements such as, for example, elements utilizing tactile stimulus, force, pressure, vibration, motion, displacement, temperature, etc.

via—by way of and/or utilizing.

weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.

when—at a time and/or during the time at which.

wherein—in regard to which; and; and/or in addition to.

while—for as long as, during the time that, and/or at the same time that.

with—accompanied by.

with regard to—about, regarding, relative to, and/or in relation to.

with respect to—about, regarding, relative to, and/or in relation to.

within—inside the limits of.

without—not accompanied by and/or lacking.

zone—a region and/or volume having at least one predetermined boundary.

Note

Various substantially and specifically practical and useful exemplary embodiments are described herein, textually and/or graphically, including the best mode, if any, known to the inventor(s), for implementing the described subject matter by persons having ordinary skill in the art. Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects skilled artisans to recognize and implement such variations, details, and/or equivalents as appropriate, and the inventor(s) therefore intends for the described subject matter to be practiced other than as specifically described herein. Accordingly, as permitted by law, the described subject matter includes and covers all variations, details, and equivalents of that described subject matter. Moreover, as permitted by law, every combination of the herein described characteristics, functions, activities, substances, and/or structural elements, and all possible variations, details, and equivalents thereof, is encompassed by the described subject matter unless otherwise clearly indicated herein, clearly and specifically disclaimed, or otherwise clearly inoperable or contradicted by context.

The use of any and all examples, or exemplary language (e.g., "such as") provided herein, is intended merely to better illuminate one or more embodiments and does not pose a limitation on the scope of any described subject matter unless otherwise stated. No language herein should be construed as necessarily indicating any described subject matter as essential to the practice of the described subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

- there is no requirement for the inclusion of any particular described characteristic, function, activity, substance, or structural element, for any particular sequence of activities, for any particular combination of substances, or for any particular interrelationship of elements;
- no described characteristic, function, activity, substance, or structural element is "essential"; and
- within, among, and between any described embodiments:
  - any two or more described substances can be mixed, combined, reacted, separated, and/or segregated;
  - any described characteristics, functions, activities, substances, and/or structural elements can be combined, integrated, segregated, and/or duplicated;
  - any described activity can be performed manually, semi-automatically, and/or automatically;
  - any described activity can be repeated, any activity can be combined with any other described activity, performed by multiple entities, and/or performed in multiple jurisdictions; and
  - any described characteristic, function, activity, substance, and/or structural element can be specifically excluded, the sequence of activities can vary, and/or the interrelationship of structural elements can vary.

The use of the terms "a", "an", "said", "the", and/or similar referents in the context of describing various embodiments (especially in the context of any claims presented herein or in any document claiming priority hereto) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into and clearly implied as being presented within the specification as if it were individually recited herein. For example, if a range of 1 to 10 is described, even implicitly, unless otherwise stated, that range necessarily includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc., even if those specific values or specific sub-ranges are not explicitly stated.

When any phrase (i.e., one or more words) described herein or appearing in a claim of an application claiming priority hereto is followed by a drawing element number, that drawing element number is exemplary and non-limiting on the description and claim scope.

No claim of this document or any document claiming priority hereto is intended to invoke 35 USC 112(f) unless the precise phrase "means for" is followed by a gerund.

Any information in any material (e.g., a patent document such as a United States patent or United States patent application, or a non-patent reference, such as a book, article, web page, etc.) that has been incorporated by reference herein, is incorporated by reference herein in its entirety to its fullest enabling extent permitted by law yet only to the extent that no conflict exists between such information and the other statements and drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Applicant intends that each claim presented herein and at any point during the prosecution of this application, and in any application that claims priority hereto, defines a distinct patentable invention and that the scope of that invention must change commensurately if and as the scope of that claim changes during its prosecution. Thus, within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, and any provided definitions of the phrases used herein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document.

What is claimed is:

1. A multi-realm board game system comprising:

a elongate first game board that defines an opposing first pair of playing surfaces, the pair comprised of a first playing surface and a second playing surface;

a elongate first axle extending longitudinally through the first game board and between the pair of playing surfaces, the first axle defining a substantially horizontally-extending first game board rotational axis;

a first plurality of supports configured to cooperatively support the first axle at a height above a bearing surface that is sufficient to allow the first game board to rotate at least a half revolution around the first game board rotational axis without contact between the first game board and the bearing surface; and a first plurality of pairs of game pieces, each pair configured to remain connected to the first game board while the first game board is rotated said at least a half revolution around the first game board rotational axis;

wherein:

each pair of game pieces from the first plurality of pairs of game pieces is configured for a first game play on the first playing surface of the first pair of playing surfaces simultaneously with a second game play on the second playing surface of the first pair of playing surfaces; and the first game board comprises a first plurality of board segments, each board segment from the first plurality of board segments configured to non-destructively detachably attach to another board segment from the first plurality of board segments.

2. The system of claim above 1, wherein:

the first game board defines a first slot configured to guide movement of the first plurality of pairs of game pieces with respect to the first game board.

3. The system of claim 1, wherein:

the first game board defines a first slot configured to operably constrain movement of the first plurality of pairs of game pieces to a direction substantially parallel to the rotational axis.

4. The system of claim 1, wherein:

the first plurality of board segments is configured to be arranged into a first sequence of attached board segments that define a first gameplay version of the first game board and the first plurality of board segments is configured to be arranged into a second sequence of attached board segments that define a second gameplay version of the first game board.

5. The system of claim 1, wherein:

each pair of game pieces from the first plurality of pairs of game pieces is non-destructively removeable from the first game board.

6. The system of claim 1, wherein:

for each pair of game pieces from the first plurality of pairs of game pieces, a first game piece is integral with a second game piece.

7. The system of claim 1, wherein:

for each pair of game pieces from the first plurality of pairs of game pieces, a first game piece is configured to be non-destructively releasably connected with a second game piece.

8. The system of claim 1, wherein:

for each pair of game pieces from the first plurality of pairs of game pieces, a first piece is configured to be magnetically connected with a second other game piece.

9. The system of claim 1, wherein:

for each pair of game pieces from the first plurality of pairs of game pieces, a first game piece is configured to be threadably connected with a second game piece.

10. The system of claim 1, wherein:

the first game board is configured to cause a selective non-destructive release of a connection between the first game board and at least one game piece from at least one pair of game pieces from the first plurality of pairs of game pieces.

11. The system of claim 1, wherein:

the first plurality of supports is configured to cooperatively support a second axle at a height sufficient to allow a second game board to rotate at least a half revolution around a second game board rotational axis without contact between the second game board and the bearing surface.

12. The system of claim 1, wherein:

each playing surface of the first pair of playing surfaces is configured for game play in a corresponding gaming realm.

13. The system of claim 1, further comprising:

a first sensor integrated into the first game board and configured to signal an occurrence of a first predetermined event involving the first game board and/or one or more pairs of game pieces from the first plurality of pairs of game pieces.

14. The system of claim 1, further comprising:

a first board motor configured to rotate the first game board a predetermined degree of rotation about the first game board rotational axis.

15. The system of claim 1, further comprising:

a elongate second game board that defines an opposing second pair of playing surfaces.

16. The system of claim 1, further comprising:

an elongate second axle extending longitudinally through a second game board and between an opposing second pair of playing surfaces, the second axle defining a second game board rotational axis.

17. The system of claim 1, further comprising:

an elongate second axle extending longitudinally through a second game board and between an opposing second pair of playing surfaces, the second axle defining a substantially horizontally-extending second game board rotational axis that is non-parallel with the first game board rotational axis.

18. The system of claim 1, further comprising:

an elongate second axle extending longitudinally through a second game board and between an opposing second pair of playing surfaces, the second axle defining a second game board rotational axis, movement of the second axle synchronized with movement of the first axle.

* * * * *